US011286618B2

(12) United States Patent
Tolfsson et al.

(10) Patent No.: US 11,286,618 B2
(45) Date of Patent: Mar. 29, 2022

(54) METHOD AND A MACHINE FOR OF MAKING TISSUE PAPER

(71) Applicant: Albany International Corp., Rochester, NH (US)

(72) Inventors: Karl-Johan Tolfsson, Forshaga (SE); Joergen Israelsson, Hammaroe (SE); Viktor Bergstroem, Karlstad (SE); Kimberly Downing, South Portland, ME (US); Johan Ragard, Karlstad (SE)

(73) Assignee: Albany International Corp., Rochester, NH (US)

( * ) Notice: Subject to any disclaimer, the term of this patent is extended or adjusted under 35 U.S.C. 154(b) by 0 days.

(21) Appl. No.: 17/055,738

(22) PCT Filed: May 15, 2019

(86) PCT No.: PCT/SE2019/050439
§ 371 (c)(1),
(2) Date: Nov. 16, 2020

(87) PCT Pub. No.: WO2019/221661
PCT Pub. Date: Nov. 21, 2019

(65) Prior Publication Data

US 2021/0207323 A1 Jul. 8, 2021

(30) Foreign Application Priority Data

May 15, 2018 (SE) ..... 1850558-6

(51) Int. Cl.
*D21F 11/00* (2006.01)
*D21F 3/02* (2006.01)
(Continued)

(52) U.S. Cl.
CPC ..... *D21F 11/006* (2013.01); *D21F 3/0209* (2013.01); *D21F 3/08* (2013.01);
(Continued)

(58) Field of Classification Search
CPC ..... D21F 11/006; D21F 3/08; D21F 3/0209; D21F 5/02; D21F 7/06; D21F 7/08;
(Continued)

(56) References Cited

U.S. PATENT DOCUMENTS 3,162,568 A 12/1964 Post
3,303,576 A 2/1967 Sisson
(Continued)

FOREIGN PATENT DOCUMENTS

EP 2126203 A1 12/2009

OTHER PUBLICATIONS

International Searching Authority, International Search Report and Written Opinion for International Application No. PCT/SE2019/050439, dated Jun. 20, 2019, (14 pages), Swedish Patent and Registration Office, Stockholm, Sweden.

*Primary Examiner* — Jacob T Minskey
*Assistant Examiner* — Matthew M Eslami
(74) *Attorney, Agent, or Firm* — McCarter & English, LLP

(57) ABSTRACT

The invention relates to a method of making tissue paper in a machine for making tissue paper and in which method a fibrous web is passed through at least one press nip together with a texturing belt. The texturing belt has a side that faces the fibrous web in the press nip and the surface of that side is a web contacting surface that is textured. The texturing belt can be selected such that the tissue paper that is manufactured obtains desired values for one or several parameters. The invention also relates to a machine for making tissue paper. The machine comprises a forming
(Continued)

section, a drying cylinder, a press having a first press unit and a second press unit between which press units a nip is formed. The second press unit is preferably a shoe roll. The machine also comprises a drying cylinder which is arranged to be heated from the inside by hot steam and on which a fibrous web can be dried by heat. A texturing belt is arranged to run in a loop through the nip and to the drying cylinder such that a fibrous web can be carried by the texturing belt to the drying cylinder and transferred to the drying cylinder. The side of the texturing belt that contacts the fibrous web comprises a layer of a polymer material such that the polymer material will contact the fibrous web and cavities are formed in that surface of the texturing belt that comes into contact with the fibrous web.

23 Claims, 23 Drawing Sheets

(51) Int. Cl.

| | |
|---|---|
| ***D21F 3/08*** | (2006.01) |
| ***D21F 5/02*** | (2006.01) |
| ***D21F 7/06*** | (2006.01) |
| ***D21F 7/08*** | (2006.01) |
| ***D21F 11/14*** | (2006.01) |
| ***D21H 27/00*** | (2006.01) |

(52) U.S. Cl.
CPC ..... *D21F 5/02* (2013.01); *D21F 7/06* (2013.01); *D21F 7/08* (2013.01); *D21F 11/14* (2013.01); *D21H 27/005* (2013.01)

(58) Field of Classification Search
CPC . D21F 11/14; D21F 7/083; D21F 3/00; D21H 27/005; D21H 27/002
See application file for complete search history.

(56) References Cited

U.S. PATENT DOCUMENTS

| | | | | |
|---|---|---|---|---|
| 4,481,722 | A | 11/1984 | Guy et al. | |
| 5,972,813 | A | 10/1999 | Polat et al. | |
| 6,547,924 | B2 | 4/2003 | Klerelid et al. | |
| 7,878,223 | B2 | 2/2011 | Kroll et al. | |
| 8,202,396 | B2 | 6/2012 | Hultcrantz et al. | |
| 2002/0062936 | A1* | 5/2002 | Klerelid | D21F 11/006 162/116 |
| 2006/0175030 | A1 | 8/2006 | Trokhan et al. | |
| 2010/0065234 | A1* | 3/2010 | Klerelid | D21F 11/006 162/111 |
| 2011/0088859 | A1 | 4/2011 | Hultcrantz | |
| 2016/0130759 | A1 | 5/2016 | Seger et al. | |
| 2017/0233946 | A1* | 8/2017 | Sealey | B32B 27/40 162/111 |

* cited by examiner

Fine Belt Land Area, with PPRC and Caliper Curves.

Fine Belt Dot Geometry, with PPRC and Caliper Curves

Fine Belt Dot Depth, with Caliper and PPRC curves.

Fine Belt Land area, with TS750 curve.

Medium Belt Land area, with Caliper and PPRC curves for bath grades.

Medium belt land area, with Caliper and PPRC curves for Towel grades.

Medium belt dot geometry, caliper and PPRC curves for bath grades.

Coarse Belt land area, with PPRC and Caliper Curves for bath.

Coarse belt Land area, Caliper and PPRC Curves for Towel.

Coarse Belt Dot Geometry, with PPRC and Caliper Curves for Bath grades.

Coarse Belt dot geometry, PPRC and Caliper curves for Towel grades.

Coarse Belt Dot depth, PPRC and Caliper curves for Bath.

Coarse belt dot diameter, PPRC and Caliper curves for towel.

Coarse Texture land area, TS750 curve.

Coarse Texture dot geometry, TS750 curve.

Coarse Texture Dot Diameter, with TS750 curve.

METHOD AND A MACHINE FOR OF MAKING TISSUE PAPER

CROSS REFERENCE TO RELATED APPLICATIONS

This application is a National Stage Application, filed under 35 U.S.C. 371, of International Application No. PCT/SE2019/050439, filed May 15, 2019, which international application claims priority to and the benefit of Swedish Application No. 1850558-6, filed May 15, 2018; the contents of both of which as are hereby incorporated by reference in their entireties.

BACKGROUND

Related Field

The present invention relates to texturing belts for making tissue paper. The invention also relates to a machine for making tissue paper and methods using said textured belt.

Description of Related Art

In the manufacture of tissue paper, it is known that a smooth and bulky tissue paper can be manufactured by so called through-air drying, commonly referred to as TAD. Examples of the TAD technology are disclosed in, for example, U.S. Pat. Nos. 4,481,722 and 3,303,576. Although tissue paper manufactured by TAD technology has good properties, the process is very energy-consuming. In order to produce tissue paper with properties comparable to what can be achieved by TAD but without consuming as much energy, it has been suggested that, instead of achieving the desired properties by TAD technology, those properties or similar properties can be achieved by using a texturing fabric that is passed through a press nip together with the fibrous web which is to become a tissue paper product. A three-dimensional structure/texture is then pressed into the fibrous web by the texturing fabric when the fibrous web passes through the press nip. Examples of such a technology are disclosed in, for example, U.S. Pat. Nos. 6,547,924 and 8,202,396. When using technologies such a texturing fabric which is pressed into a fibrous web that is still wet, it is desirable that the properties of the tissue paper web can be controlled. The object of the present invention is to provide a texturing belt and a machine which permit control of the desired properties.

BRIEF SUMMARY

The invention relates to a texturing belt for making tissue paper in a machine for making tissue paper. In an inventive method using said textured belt, a fibrous web is passed through at least one press nip together with a texturing belt having a side that faces the fibrous web in the press nip and the surface of that side being a web contacting surface that is textured. In preferred embodiments of the invention as disclosed with reference to FIGS. 1-22, the texturing belt is selected such that the tissue paper that is manufactured obtains desired values for one or several parameters.

In preferred embodiments of the invention, the side of the texturing belt that faces the fibrous web comprises a layer of a polymer material such that the surface of the texturing belt that contacts the fibrous web in the press nip is a surface formed by the polymer material. The polymer material can in particular be polyurethane or a material with properties similar to those of polyurethane.

The inventors have found that good properties of the tissue paper can be achieved when the surface of the texturing belt that faces the fibrous web in the press nip is textured in such a way that cavities are formed in the polymer material forming the surface facing the fibrous web. In the context of this patent application, the cavities may also be termed "dots".

Good results can be achieved when the cavities/dots have a depth in the range of 0.10 mm-0.9 mm, preferably a depth in the range of 0.15 mm-0.70 mm; even more preferred a depth in the range of 0.20 mm-0.50 mm. Most preferred the cavities/dots should have a depth in the range of 0.20 mm-0.40 mm.

For all embodiments of the invention as described with reference to FIGS. 1-20, it is advantageous if that part of the web contacting surface of the structuring belt that lies between the cavities/dots define a land area which land area constitutes 30%-80% of the total area of the web contacting surface, preferably 30%-70% of the total area of the web contacting surface.

For all embodiments of the invention as described with reference to FIGS. 1-20, the cavities/dots are preferably distributed over the entire width of the texturing belt and preferably evenly distributed.

The land area is preferably plain, i.e. substantially smooth.

The inventors have tested texturing belts that can be broadly classified in three separate groups, fine textured belts, medium textured belts and coarse textured belts.

Fine textured belts can have cavities/dots with a depth in the range of 0.15 mm-0.32 mm, in particular 0.2 mm-0.32 mm. For fine textured belts, the part of the web contacting surface that lies between the cavities may define a land area which land area constitutes 50-80% of the total area of the web contacting surface, preferably 56%-67% of the total area of the web contacting surface. For fine textured belts, each cavity may have an area in the range of 0.60 $mm^2$-0.70 $mm^2$ and preferably 0.64 $mm^2$. In this context, the "area" of a cavity (or dot) should be understood as the area which can be seen from a direction which is perpendicular to the plane of the belt surface.

For both fine textured belts, medium textured belts and coarse textured belts, each cavity may have a circular shape. However, the texturing belts may also have cavities/dots that have an oval shape. If an oval shape is used, the dots can be extended in either the machine direction (the direction in which the machine is running) or in the cross-machine direction. For example, a dot/cavity may be stretched in the machine direction (MD) with a ratio of 1.5:1 or it can be stretched in the cross-machine direction (CD) with a ratio of 2:1, i.e. the ratio between extension in the cross-machine direction and extension in the machine direction.

For medium textured belts, the cavities have a depth in the range of 0.20 mm-0.40 mm, preferably a depth in the range of 0.25 mm-0.35 mm and most preferred a depth of 0.30 mm. The dot area (cavity area) of medium textured belts may be in the range of 0.80 $mm^2$-1.30 $mm^2$ and preferably an area of 1.13 $mm^2$. For medium textured belts, the part of the web contacting surface that lies between the cavities define a land area which land area may constitute 30%-70% of the total area of the web contacting surface and which preferably constitutes 46%-65% of the total area of the web contacting surface.

Also for medium textured belts, the dots/cavities may have a circular shape or an oval shape that is stretched in the machine direction or in the cross-machine direction. For example, medium textured belts may have cavities/dots of an oval shape such that the cavity is extended in the machine direction with a ratio of 1.5:1 between machine direction extension and cross machine direction extension.

Medium textured belts may also have cavities with an oval shape extended in the cross-machine direction, for example with a ratio of 2:1 between extension in the cross-machine direction and extension in the machine direction.

For coarse textured belts, the cavities may have a depth in the range of 0.35 mm-0.50 mm, for example a depth of 0.40 mm.

For coarse textured belts, the part of the web contacting surface that lies between the cavities may define a land area which land area may constitute 30%-70% of the total area of the web-contacting surface and preferably constitutes 46%-64% of the total area of the web contacting surface.

As is the case with fine textured belts and medium textured belts, coarse textured belts may have dots/cavities that are shaped such that each cavity has either a circular shape, an oval shape extended in the cross-machine direction or an oval shape extended in the machine direction.

The coarse textured belts may have cavities/dots that are shaped such that the largest diameter of each cavity is in the range of 1.30 mm-2.50 mm. Preferably, the largest diameter of each dot/cavity of the coarse textured belts is in the range of 1.34 mm-2.25 mm, even more preferred in the range of 1.40 mm-1.80 mm. In some embodiments, the largest diameter for cavities of the coarse textured belt may be 1.73 mm.

The coarse textured belt may have cavities/dots with an area in the range of, for example, 1.60 $mm^2$-2.50 $mm^2$, preferably in the range of 1.90 $mm^2$-2.30 $mm^2$. For example, the area of the dots of a coarse textured belt may be 2.27 $mm^2$.

Coarse textured belts can also have dots that are either round or oval. If they are oval, they can be oriented in either the machine direction or the cross-machine direction. For example, if they are oriented (extended) in the machine direction, By selecting various combinations of the diameter or area of the cavities/dots, the depth of the cavities and the amount of land area between the cavities of the texturing belt, one or several desired properties of the tissue paper can be optimized, controlled and/or influenced. Such desired properties may include Post Press Roll Consistency (i.e. dryness of the fibrous web after the fibrous web has passed through the press nip), the caliper and/or or the softness.

In all embodiments of the invention, the fibrous web can be passed together with the texturing belt through a nip between two rolls of which one roll is a shoe roll. The nip may thus be a shoe press nip and the use of a shoe press is advantageous. The linear load in the nip may be selected according to what is deemed suitable for each specific case. However, in many realistic embodiments, the linear load in the nip may be 600 kN/m but other values can also be considered, for example linear loads in the range of 300-700 kN/m, preferably 500 kN/m-700 kN/m. Embodiments are also conceivable in which the linear load in the nip may even be higher than 700 kN/m. The inventors have found that 600 kN/m or about 600 kN/m is suitable for many practical cases. After pressing with the textured belt, the fibrous web can be transferred from the texturing belt to a drying cylinder, the fibrous web is then dried on the drying cylinder and subsequently creped from the drying cylinder. The machine can be operated such that the speed of the machine is lower after creping from the drying cylinder than before transfer of the fibrous web to the drying cylinder. In many practical embodiments, machine speed after creping may be 10%-30% lower than before transfer of the web to the drying cylinder, preferably 18% lower or about 18% lower.

For both Fine textured belts, Medium textured belts and Coarse textured belts, the shape of oval dots may be varied. This applies both when the dots are stretched in the machine direction and when they are stretched in the cross-machine direction. For example, Fine textured belts and Medium textured belts may have dots stretched in the machine direction with a ratio between extension in the machine direction and extension in the cross-machine direction that can conceivably be varied within a range of 1.3:1-2.3:1. For example, the ratio may be 1.5:1 or 2:1. In the same way, Fine textured belts and Medium textured belts may have dots stretched in the cross-machine direction with a ratio between extension in the cross-machine direction and extension in the machine direction that can conceivably be varied within a range of 1.6:1-2.2:1.

For Coarse textured belts, dots stretched in the cross-machine direction may conceivably have a ratio between extension in the cross-machine direction and extension in the machine direction that varies within the range of, for example, 1.4:1-2:1. For coarse textured belts, dots stretched in the machine direction MD may conceivably have a ratio between extension in the machine direction and extension in the cross-machine direction that varies within the range of, for example, 1.4:1-2.1:1.

The invention can also be described in terms of a machine for making tissue paper. The inventive machine comprises a forming section, a drying cylinder such as a Yankee drying cylinder and a press section. The press section has a first press unit and a second press unit between which press units a nip is formed. The second press unit is preferably a shoe roll while the second press unit may be a roll that acts as a counter roll for the shoe roll. For example, the second press unit may be a deflection compensated roll or a roll with camber. The inventive machine also comprises a drying cylinder which arranged to be heated from the inside by hot steam and on which a fibrous web can be dried by heat. The drying cylinder may in particular be a Yankee drying cylinder with internal grooves. The Yankee may be, for example, a Yankee made of cast iron, but it may also be a Yankee made of welded steel, for example a Yankee as disclosed in EP 2126203. According to an important aspect of the invention, the inventive machine comprises a texturing belt. The texturing belt can be used to create a texture, i.e. a three-dimensional structure, in the fibrous web. The texturing belt can be arranged to run in a loop through the nip and to the drying cylinder such that a fibrous web can be carried by the texturing belt to the drying cylinder and transferred to the drying cylinder. The side of the texturing belt that contacts the fibrous web comprises a layer of a polymer material such that the polymer material will contact the fibrous web and cavities are formed in that surface of the texturing belt that comes into contact with the fibrous web, i.e. the surface with a polymer layer. In the context of this patent application, the cavities may also be referred to as "dots".

The polymer material of the texturing belt used in the inventive machine may be polyurethane or a material having properties similar to polyurethane.

The cavities (or dots) in the surface of the polymer material of the texturing belt may have a depth in the range of 0.10 mm-0.9 mm, preferably a depth in the range of 0.15 mm-0.70 mm, even more preferred a depth in the range of 0.20 mm-0.50 mm and most preferred a depth in the range of 0.20 mm-0.40 mm.

In embodiments of the inventive machine, when texturing belts as described with reference to FIGS. 1-20 are used, the cavities have a depth in the range of 0.2 mm-0.32 mm while the part of the web contacting surface that lies between the cavities define a land area which land area constitutes 56-67% of the total area of the web contacting surface.

The inventive belt and the inventive machine are suitable for making tissue paper with a basis weight in the range of 10 g/m$^2$-50 g/m$^2$ (referring to the basis weight of the ready-dried product after drying on the drying cylinder). The inventive belt and the inventive machine can be used to manufacture, for example, bathroom grades, facial tissue or towel.

In another aspect of the inventive belt, the cavities may be distributed in such a way over the web-facing surface that an imaginary grid placed over the web-facing surface divides the surface into a repeating pattern of rectangular cells. Each cell may comprise at least one cavity and a surrounding land area and each cell may extend in the machine direction by 0.5 mm-5 mm, preferably 0.5 mm-4 mm and even more preferred 0.5 mm-3 mm. According to this aspect of the invention, the depth of each cavity may be in the range of 0.10 mm-0.50 mm.

In embodiments in which the cavities are in a pattern of repeating cells, the land area of each cell preferably covers 30%-70% of the total area of the cell.

The cells can be distributed in rows that extend in the cross-machine direction and wherein the cells of adjacent rows may optionally be displaced in relation to each other in the cross-machine direction.

Alternatively, the cells may be distributed in rows extending in the machine direction while the cells of adjacent rows are displaced in relation to each other in the machine direction.

Possibly, each cell comprises at least two separate cavities of different depth and or diameter.

It follows that the inventive machine may also be described in terms of a machine using a texturing belt with cavities/dots that are distributed in such a way over the web-facing surface that an imaginary grid placed over the web-facing surface divides the surface into a repeating pattern of rectangular cells. Each cell may then comprise at least one cavity and a surrounding land area and wherein each cell may extend in the machine direction by 0.5 mm-5 mm, preferably 0.5 mm-4 mm and even more preferred 0.5 mm-3 mm. The depth of each cavity is in the range of 0.10 mm-0.50 mm. Preferably, the land area of each cell covers 30%-70% of the total area of the cell. Optionally, the cells can be distributed in rows that extend in the cross-machine direction while the cells of adjacent rows are displaced in relation to each other in the cross-machine direction. Alternatively, the cells may be distributed in rows extending in the machine direction while the cells of adjacent rows are displaced in relation to each other in the machine direction.

In some embodiments, each cell may comprise at least two separate cavities of different depth and/or diameter.

An embodiment of the inventive texturing belt may thus be as follows. The texturing belt is a texturing belt for making a three-dimensional pattern in a fibrous web during the manufacture of tissue paper. The texturing belt has a side which is intended to contact the fibrous web when the tissue paper is manufactured. The web-contacting side has cavities that are distributed in such a way over the web-facing surface that an imaginary grid placed over the web-facing surface divides the surface into a repeating pattern of rectangular cells. Each cell comprises at least one cavity and a surrounding land area and each cell extends in the machine direction by 0.5 mm-5 mm, preferably 0.5 mm-4 mm and even more preferred 0.5 mm-3 mm. In this embodiment of the inventive texturing belt, the depth of each cavity may be in the range of 0.10 mm-0.50 mm. The land area of each cell preferably covers 30%-70% of the total area of the cell.

In some embodiments, the cells can be distributed in rows that extend in the cross-machine direction while the cells of adjacent rows are displaced in relation to each other in the cross-machine direction. Alternatively, the cells may be distributed in rows extending in the machine direction while the cells of adjacent rows are displaced in relation to each other in the machine direction.

Embodiments are also conceivable in which each cell comprises at least two cavities of different depth and/or diameter or area.

Other embodiments of the texturing belt and the machine are explained in the detailed description and specific embodiments can be derived from the text and figures of the detailed description.

DETAILED DESCRIPTION OF VARIOUS EMBODIMENTS

Figure 1:
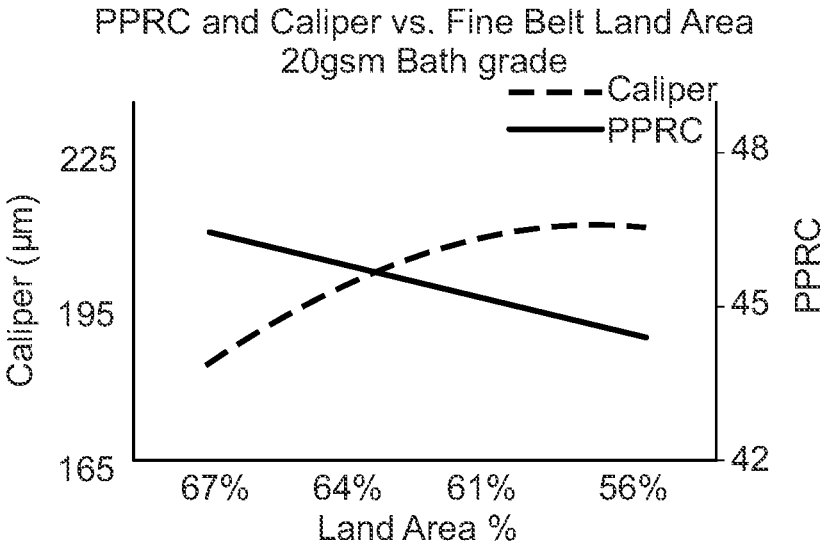
FIG. 1 is a diagram/graph showing the relationship between land area and dryness (PPRC) and caliper for a fine textured belt.

With reference to FIG. 1-FIG. 20, a study on the design of texturing belts has been performed by the applicant. The study has been made on belts of the kind that are sold under the name NTT® but the findings are applicable to a wide range of polymer-coated texturing belts. One object of the study was to find out how different texturing belts affect energy consumption. Another purpose was to find out how different texturing belts affect product properties, i.e. the properties of the tissue paper web that is manufactured. The belts have been made with cavities in that surface of the texturing belt that contacts the fibrous web during manufacturing. In the following, such cavities may also be referred to as "dots". The different texturing belts have been made with dots (i.e. cavities) that are engraved into a polyurethane belt (the belt surface that contacts the fibrous web during manufacturing is formed by polyurethane). The texturing belts may conceivably be covered by other polymers than polyurethane, but such polymers should preferably have properties similar to polyurethane. The dots in the texturing belts are made with a given area, shape, depth and spacing between them. Those parts of a texturing belt where there are no dots (cavities) are referred to as "land areas". The study that was performed worked to explore the possibilities for how the dots can be engraved on belts as well as to increase understanding of the relationship between belt design and product properties.

The next generation of texturing belts should allow for more customization and optimization of each tissue manufacturer's goals. Previously, there has been three categories of texturing: Fine, Medium and Coarse. The fine belt category is ideal for bath grades, producing TAD-like texture and excellent softness and the energy efficiency is good. The medium belt produces a mix of a bulky bath grade to a more economical towel grade. Finally, the coarse belts are ideally suited for extra bulky bath grades and bulky towel grades. The next generation will refer to these categories but be more of a spectrum of possible belt designs, including many dot shapes and orientations from ovals in the machine- and cross-machine direction to dots with variable sizes arranged in specific patterns that include round and oval dots.

The study, which aimed at understanding belt design and properties, was focused on which designs that optimize caliper of the base sheet and Post Press Roll Consistency (PPRC), i.e. dryness to ensure good machine efficiency. For each category of belts, a variety of land area, dot shape and dot size were tested and compared to reference product samples. Many variations of machine settings were tested to ensure that the data was consistent. With reference to the figures, basic summary graphs for the three general categories will be discussed in the following to give the reader a better understanding of the general relationship between belt design and product properties. This will enable the tissue manufacturer to mix and match different dot designs, creating new patterns, that match exactly their product goals and allow for the optimization of energy consumption at the same time.

Fine Textured Belts

Several different belt designs were tested that fall into the general category of fine textured belts. Typically, a fine belt texture has a dot depth of 0.25 mm and a dot area of 64 mm$^2$. The fine belts tested ranged in land area from as high as 67% land area to as low as 56% land area. Belts with various dot depths were also tested, these ranged from a doth depth of 0.20 mm to a dot depth of 0.32 mm. Various dot shapes were also tested, from an oval that is stretched in the cross-machine direction with a ratio of 2:1 to an oval that is stretched in the machine direction with a ratio of 1.5:1 with a round dot as a reference point.

Influence of Land Area on Caliper and PPRC for Fine Texture Belts

The Fine belt category tests, which focused on land area, were aimed at correlating land area with caliper and PPRC and finding the resulting curves. It was previously understood that a decrease in the land area should lead to gains in caliper, but it was not known what the limitations were, what the curve would look like and how dryness (PPRC) would be affected. It will be understood that PPRC can be seen as an indication of energy efficiency. If PPRC is low, that means that more water must be removed by drying which requires more energy. Higher PPRC thus means better energy efficiency. FIG. 1 shows Fine Belt land area with PPRC and caliper curves. As can be seen from FIG. 1, decreasing land area has a great impact on caliper, but this impact decreases between 61% and 64% land area. This is also were PPRC really starts to drop off. The curves in FIG. 1 makes it possible for tissue manufacturers to pick and choose the features that are most important to them and select a design of the belt based on that. If, for example, caliper is significantly more important than energy consumption, the tissue manufacturer might select a belt design with 55% land area whereas a manufacturer who finds reduction of the energy consumption to be of paramount concern may select a belt on the other end of the spectrum with 70% land area.

Influence of Dot Geometry on Caliper and PPRC for Fine Texture Belts

Figure 2:
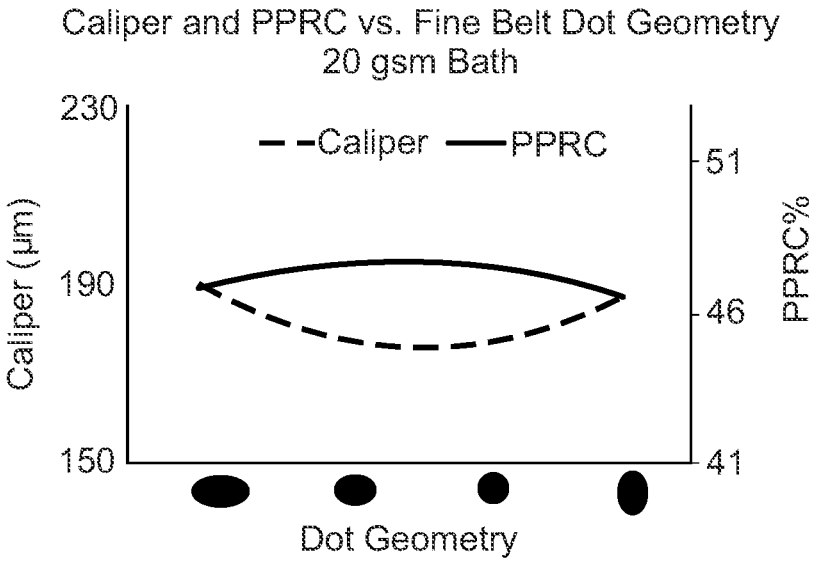
FIG. 2 shows the influence of dot geometry (geometry of cavities) on caliper and dryness (PPRC) for a fine textured belt.

Reference will now be made to FIG. 2 which shows Fine Belt Dot Geometry with PPRC and caliper curves. When the influence of dot geometry on product properties was investigated, it was found that the use of dots that have an oval shape with the long direction being in the cross-machine direction (see FIG. 2) resulted in higher caliper than when round dots were used with very little effect on PPRC.

Without wishing to be bound by theory, it is believed by the inventors that the explanation for this effect is that the dots that are stretched in the CD (the cross-machine direction) produce a pocket in the sheet that will not be collapsed during the subsequent creping. Looking at the curve of caliper in FIG. 2, a slight rise can be seen when going from a round dot to an oval dot that is stretched in the machine direction (MD). An explanation for this may be that the pocket created by the dot collapsed during creping and this collapsed dot resulted in some additional caliper as compared to the round dot. However, the sheet produced on the machine-direction oval appeared less uniform than the sheet produced with the cross-machine oval.

Influence of Dot Depth on Caliper and PPRC for Fine Texture Belts

Figure 3:
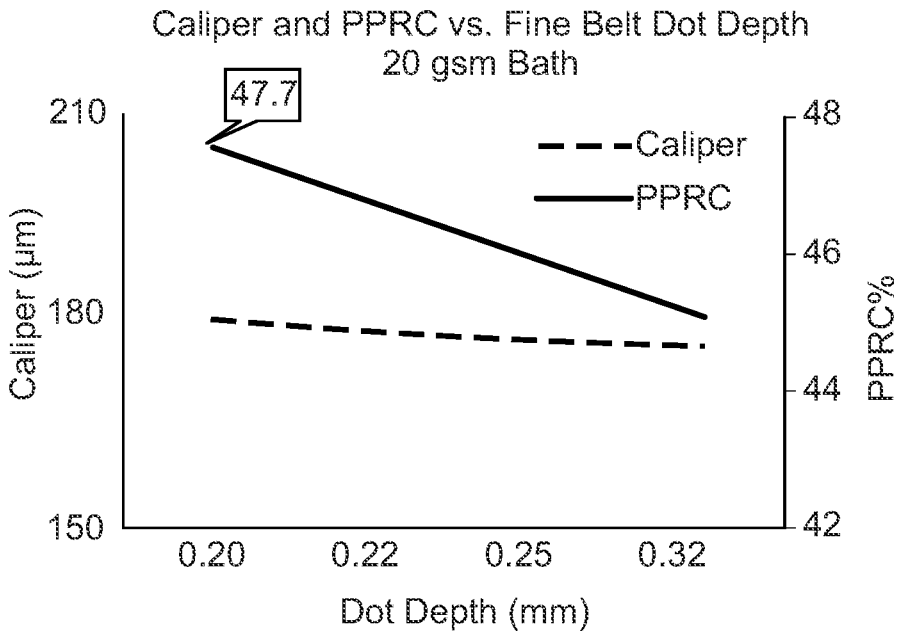
FIG. 3 is a diagram/graph showing the influence that depth of cavity (dot depth) has on dryness (PPRC) and caliper for a fine textured belt.

Reference will now be made to FIG. 3 which shows Fine belt doth depth with caliper and PPRC curves. The influence that dot depth has on caliper for the Fine belt over a range of 0.20 mm to 0.32 mm was found to be insignificant. With regard to PPRC, dot depth had a significant impact.

It is clear from the trials that the dot diameter and dot depth go hand in hand. As the dot diameter is decreased, the dot depth must be decreased. As the dots become smaller, it becomes more difficult to fill a deep dot with fibers and more water will be carried in the bottom of the dot instead of fiber. The goal would be to optimize a dot area with a sufficient dot depth to maximize caliper but not allow PPRC to suffer, see the graph in FIG. 3 which shows a relatively flat caliper curve with a strong slope to the PPRC curve.

Influence of Belt Properties on Surface Smoothness for Fine Texture Belts

Figure 4:
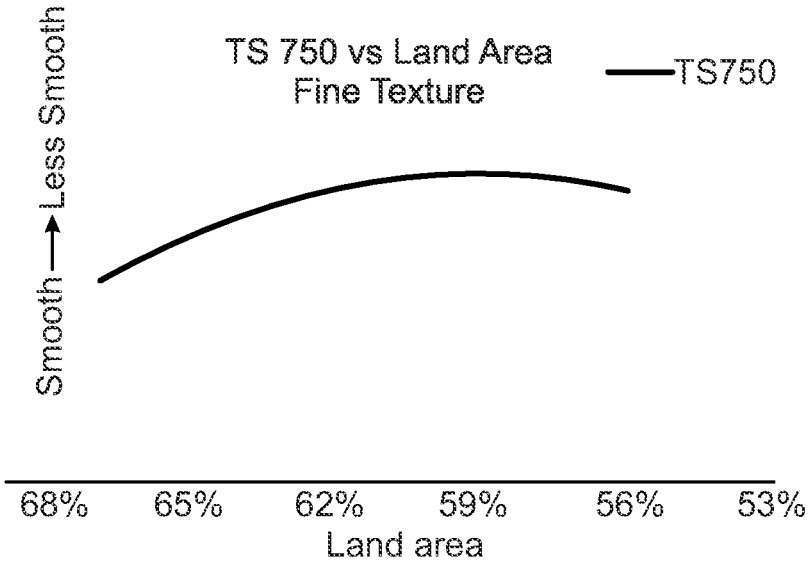
FIG. 4 is a diagram/graph showing the effect of land area on smoothness of the tissue paper product when a fine textured belt is used.

Reference will now be made to FIG. 4 which shows Fine belt land area with TS750 curve. While choosing Fine texture belts that are generally used for Bath grades and the like, softness is an important factor for the choice of belt design. The primary component of TSA (Tissue Softness Analyzer) that would be affected by the belt design is surface smoothness (TS750). TS750 is an industry standard for smoothness and a lower value means higher smoothness. In the graph showing TS750 vs. Land area (See FIG. 4), it can be seen that a higher value for Land area results in a smoother sheet. This can translate to potentially higher TSA numbers.

Figure 5:
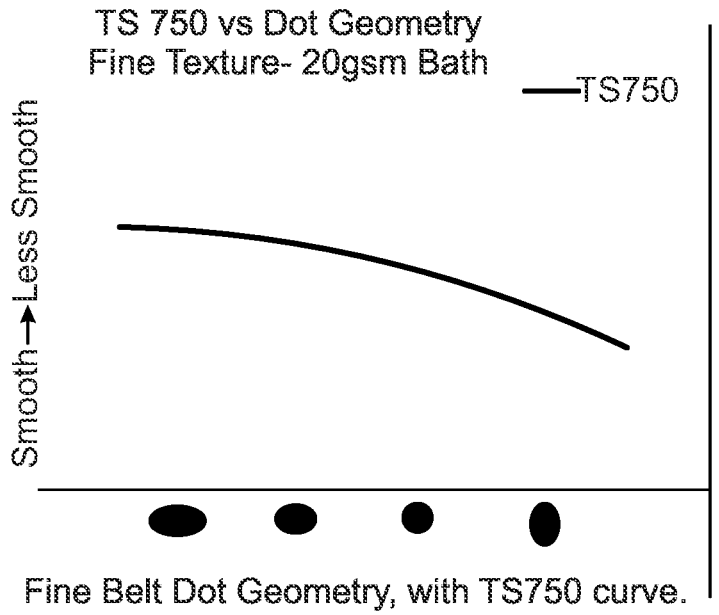
FIG. 5 is a diagram/graph showing the effect of belt dot geometry (geometry of cavities) on smoothness for a fine textured belt.
Figure 6:
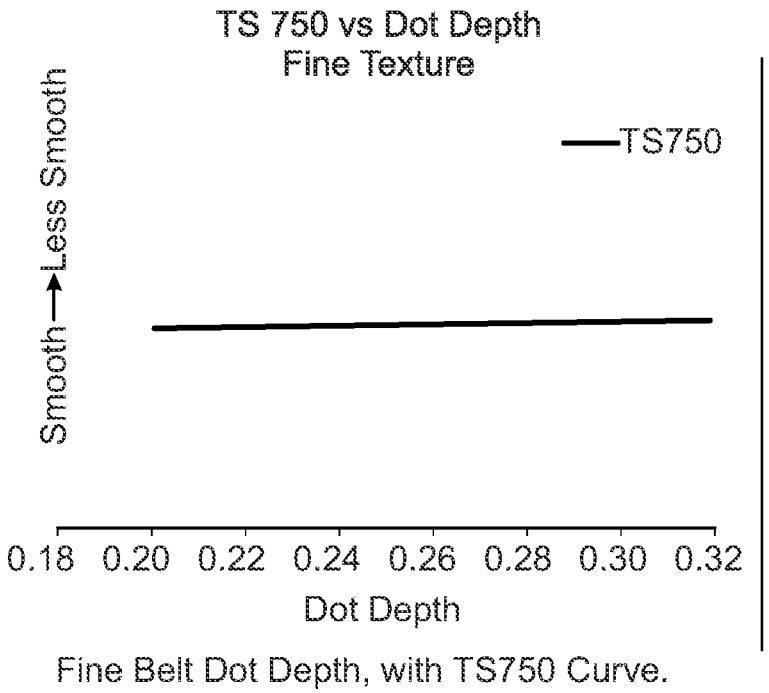
FIG. 6 is a graph/diagram showing the effect of dot depth (depth of cavities) on smoothness.

Reference will now be made to FIG. 5 which shows Fine belt dot geometry with TS750 curve and to FIG. 6 which shows Fine belt dot depth with TS750 curve. The dot shape is also thought to influence smoothness. It was discovered that the oval dot stretched in the machine direction produced a smoother sheet (see FIG. 5). The impact that dot depth has on sheet smoothness was also found to be insignificant. This correlates well with the insignificant impact dot depth had on caliper (see FIG. 6).

Medium Textured Belts

Several different belts were also tested which fall into the general category of Medium texture belts that have a dot depth of 0.3 mm and a dot area of 1.13 $mm^2$. These belts ranged in land area from as high as 65% land area to as low as 46% land area. Various dot shapes were tested, from an oval that is stretched in the cross-machine direction (CD) with a ratio of 2:1 to an oval that is stretched in the machine direction (MD) with a ratio of 1.5:1, with a round dot as a reference point. No variation in dot depth was tested for Medium texture belts.

Influence of Land Area on Caliper and PPRC for Medium Texture Belts

Figure 7:
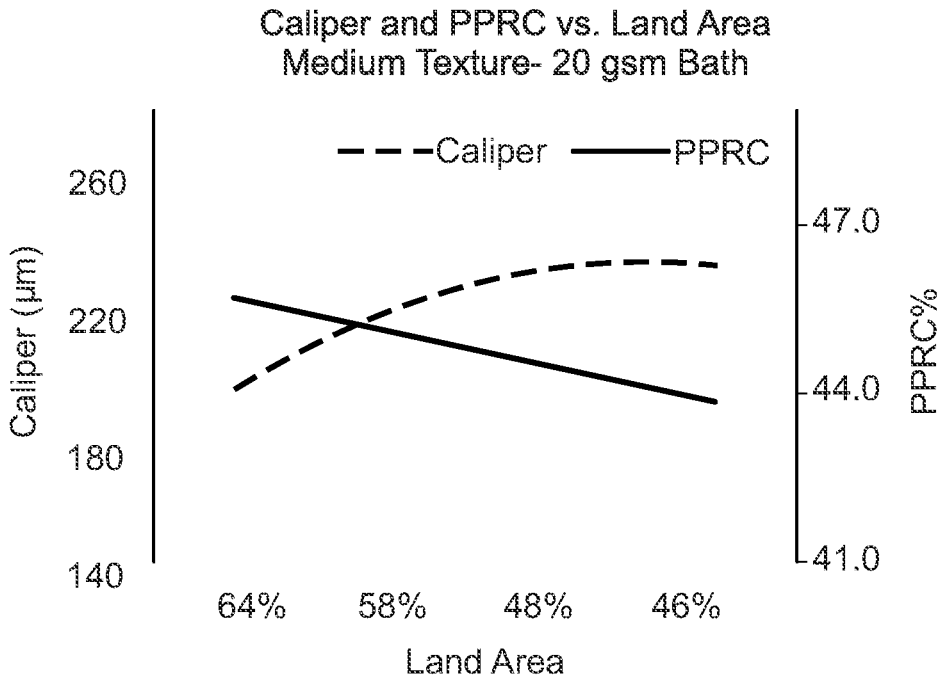
FIG. 7 is a diagram/graph showing the effect of land area on dryness (PPRC) and caliper on a 20 g/m$^2$ bath product when a medium textured belt is used. The land area in FIG. 7 is shown as varying from 64% at the left to the low value of 46%.

Reference will now be made to FIG. 7 which shows Medium belt land area, with caliper and PPRC curves for bath grades and to FIG. 8 which shows Medium belt land area with caliper and PPRC curves for Towel grades. The influence of land area found for Medium textured belts closely followed the results found for Fine textured belts. Lower land area resulted in greater caliper but lower PPRC. The data was reduced in the same manner as for Fine belt data. FIG. 7 shows the caliper and PPRC curves for various land areas with Medium texture.

Figure 8:
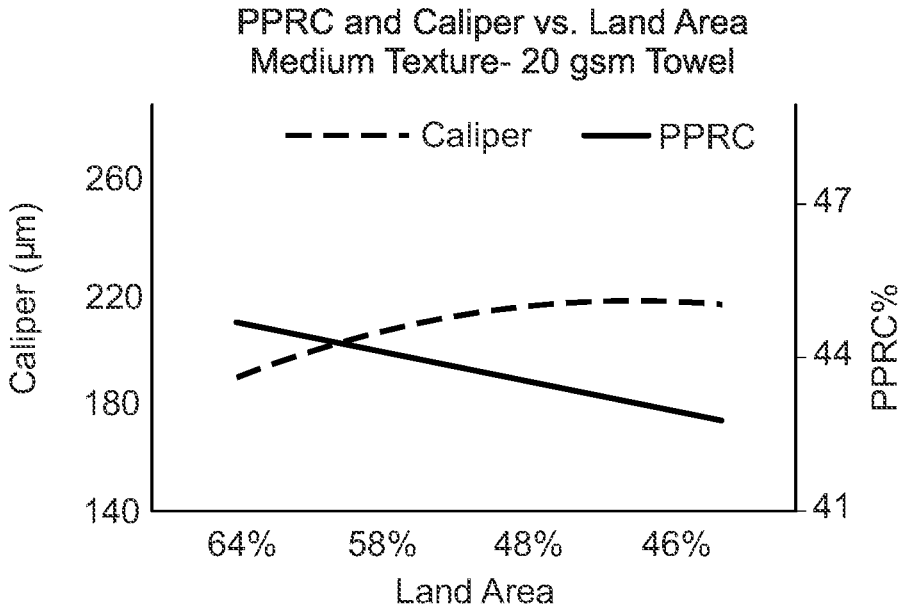
FIG. 8 is a diagram/graph showing the effect of land area on dryness (PPRC) and caliper on a 20 g/m$^2$ Towel product when a medium textured belt is used.

Since Medium texture belts are generally used for towel as well as bath, the same curves were made for Towel grades (see FIG. 8).

The curves for both Bath and Towel grades are quite similar. There seems to be better caliper generation with Bath grades. These curves should serve as a guide in choosing a land area that best suits the needs of the tissue manufacturer in order to balance the desired product qualities with the need to conserve energy.

Influence of Dot Geometry on Caliper and PPRC for Medium Textured Belts

Figure 9:
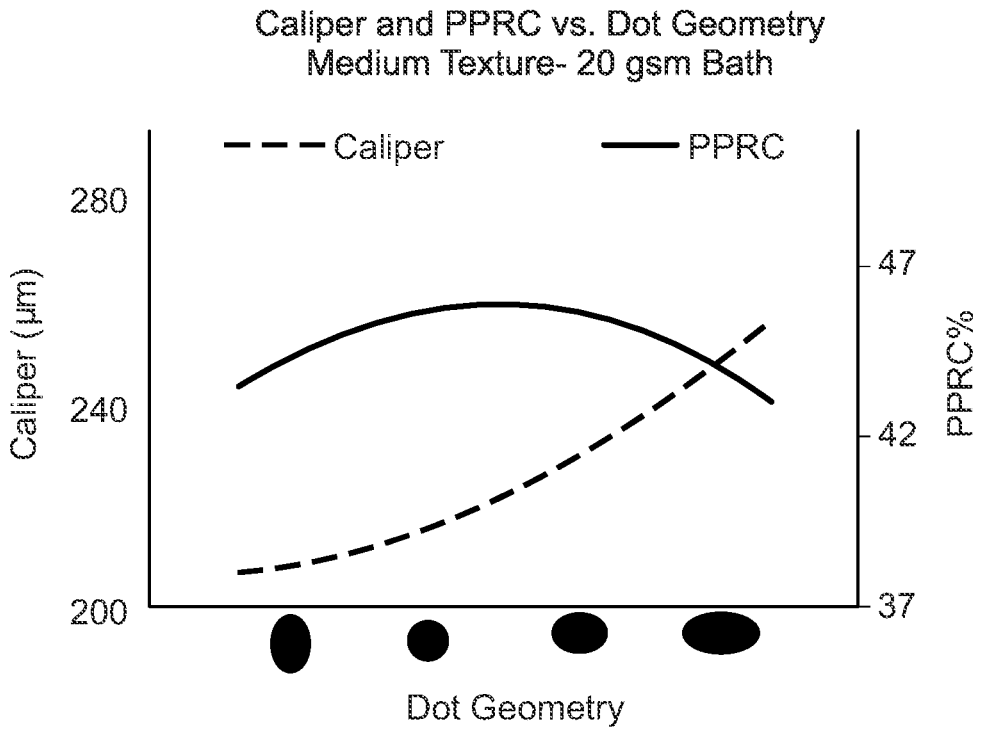
FIG. 9 is a diagram/graph showing the effect of dot geometry (shape of cavities) on caliper and PPRC (dryness) on a 20 gsm (g/m$^2$) Bath product when a medium textured belt is used.

Reference is made to FIG. 9 which shows Medium belt dot geometry, caliper and PPRC curves for Bath grades. Four different dot geometries were tested for Medium texture belts, with the oval dot stretched at a ratio of 2:1 in the cross-machine direction (the area is the same as the standard round dot for Medium textured belts), an oval dot stretched at a ratio of 1.5:1 in the cross-machine direction, a round dot and an oval dot stretched at a ratio of 1.5:1 in the machine-direction (MD). These geometries were tested for Bath grades only. It has been shown that the caliper and PPRC curves for Towel closely match those seen on Bath grades.

Influence of Belt Properties on Surface Smoothness for Medium Textured Belts

Figure 10:
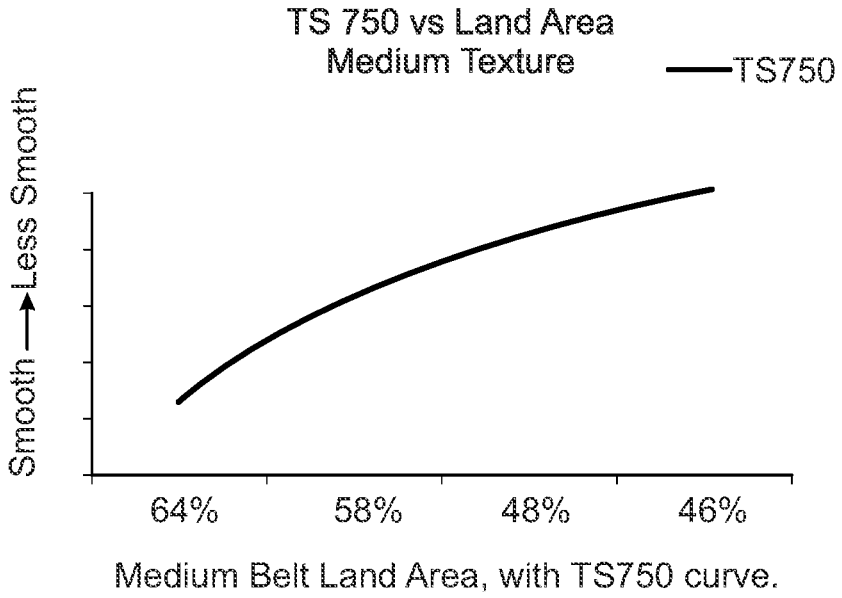
FIG. 10 is a diagram/graph showing the effect of land area on smoothness for a medium textured belt.

Reference is made to FIG. 10 which shows Medium belt land area with TS750 curve (i.e. TS750 as a function of land area). The effects for surface smoothness were also considered for Medium textured belts. The properties that have been found to influence surface smoothness for Medium belts was dot geometry and land area. The inverse relationship between caliper and surface smoothness that was discovered for Fine textured belts carries over to Medium textured belts. In FIG. 10, the smoothness (TS750) is graphed against land area to show the impact that land area has on sheet smoothness.

Coarse Textured Belts

Figure 11:
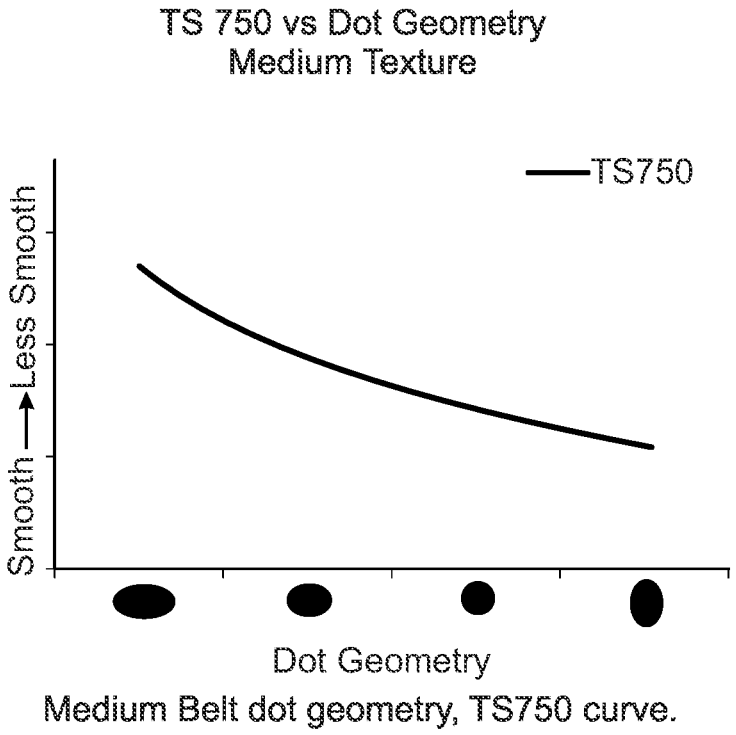
FIG. 11 is a diagram/graph showing the effect of dot geometry (shape of cavities) on smoothness when a medium textured belt is used.

Several different belts were also tested which fall into the general category of Coarse textured belts. Coarse belts generally have larger and deeper dots than Medium or Fine textured belts. Coarse texture dots are typically 0.40 mm deep with an area for each dot of 2.27 $mm^2$. The same process for mapping the effects on caliper, PPRC and smoothness but on a Coarse structure was carried out for the belt properties dot geometry, land area and dot diameter. Reference is now made to FIG. 11 which shows the TS750 curve for Medium belt dot geometry. The geometries that were tested were oval stretched in the cross-machine direction with a 1.5:1 (to the right in FIG. 11); round dot (second from the right in FIG. 11); oval dot stretched in the machine direction with a 1.5:1 ratio (third from the right in FIG. 11); and oval dot stretched in the machine direction with a 2:1 ratio (to the left in FIG. 11). Land area was tested with a low land area value of 46% (i.e. 46% of total area including the area of the dots) and a high land area value of 64%. Dot diameter was tested with a lower dot diameter of 1.34 mm and a high dot diameter value of 2.25 mm. The Coarse belts were tested with both Bath and Towel grades.

Influence of Land Area on Caliper and PPRC for Coarse Textured Belts

Figure 12:
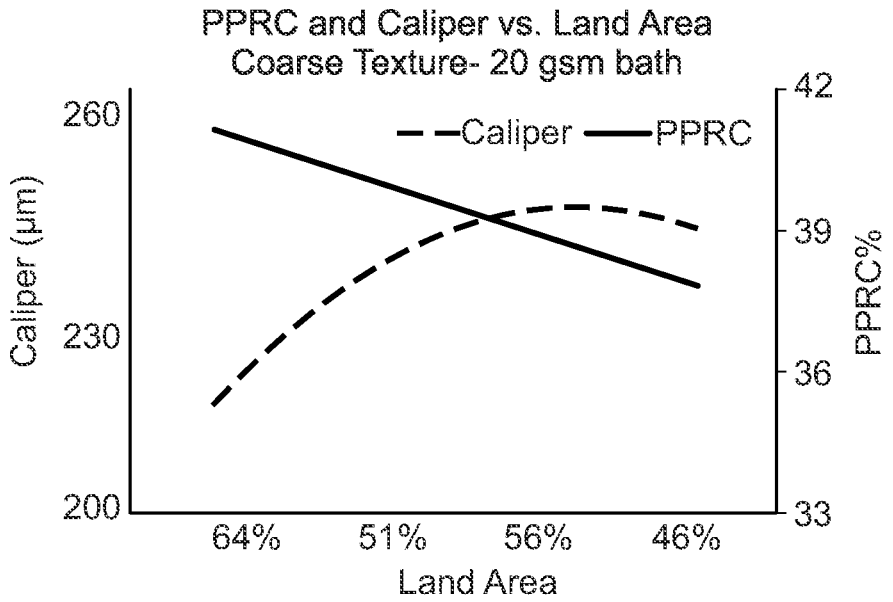
FIG. 12 is a graph/diagram showing the effect of land area on caliper and PPRC (i.e. dryness) on a 20 gsm (g/m$^2$) Bath product when a medium textured belt is used.
Figure 13:
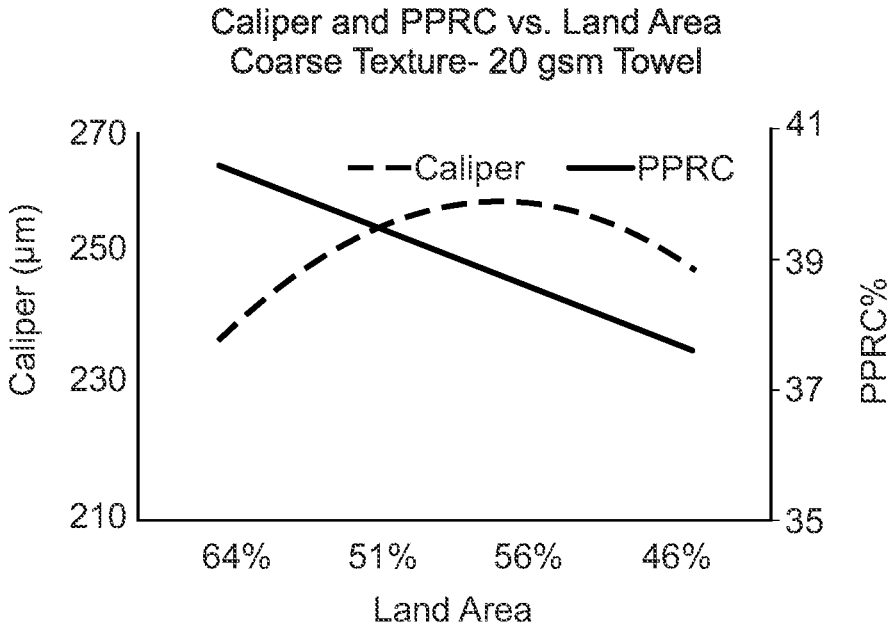
FIG. 13 is a diagram/graph showing the effect of land area on caliper and PPRC on a 20 gsm (g/m$^2$) Towel product when a medium textured belt is used.

The Coarse texture land area trials can be summarized in a similar fashion as the Fine and Medium textured belts. The low land area resulted in good caliper but lower PPRC and the higher land area pattern resulted in lower caliper but higher PPRC. The curve for PPRC is linear whereas the caliper curve is a $2^{nd}$ order polynomial. Reference will now be made to FIG. 12 which shows PPRC and caliper as a function of land area for Bath. The graph shown in FIG. 12 shows these two curves for Bath grades and allows tissue manufacturers to choose that compromise that best suits their needs. The corresponding curves for Towel grades are shown in FIG. 13 and as can be seen in FIG. 12 and FIG. 13, the curves for Bath and Towel are quite similar.

Influence of Dot Geometry on Caliper and PPRC for Coarse Textured Belts

Figure 14:
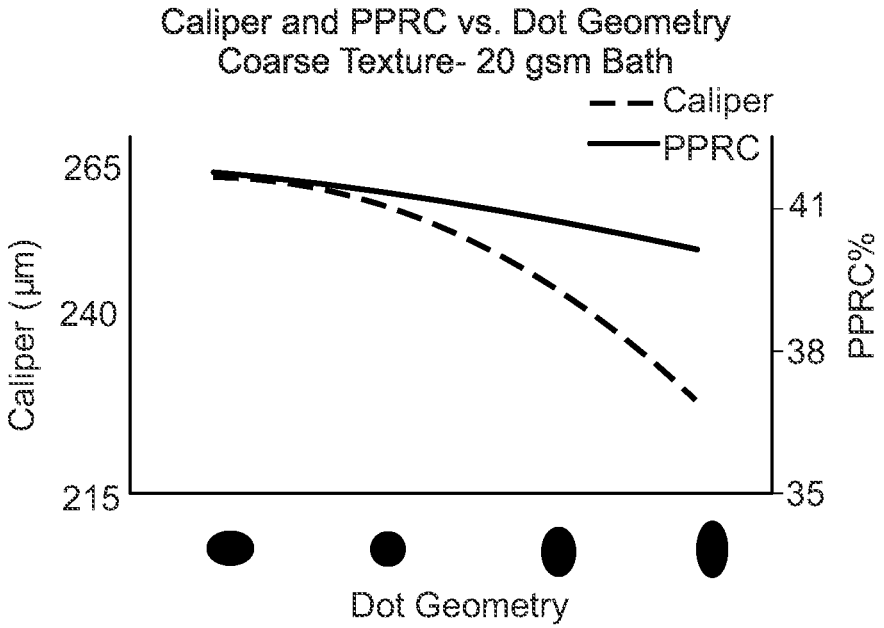
FIG. 14 is a graph/diagram relating to a coarse textured belt and shows the effect of dot geometry (shape of cavities) for a 20 gsm (g/m$^2$) Bath product on caliper and PPRC.
Figure 15:
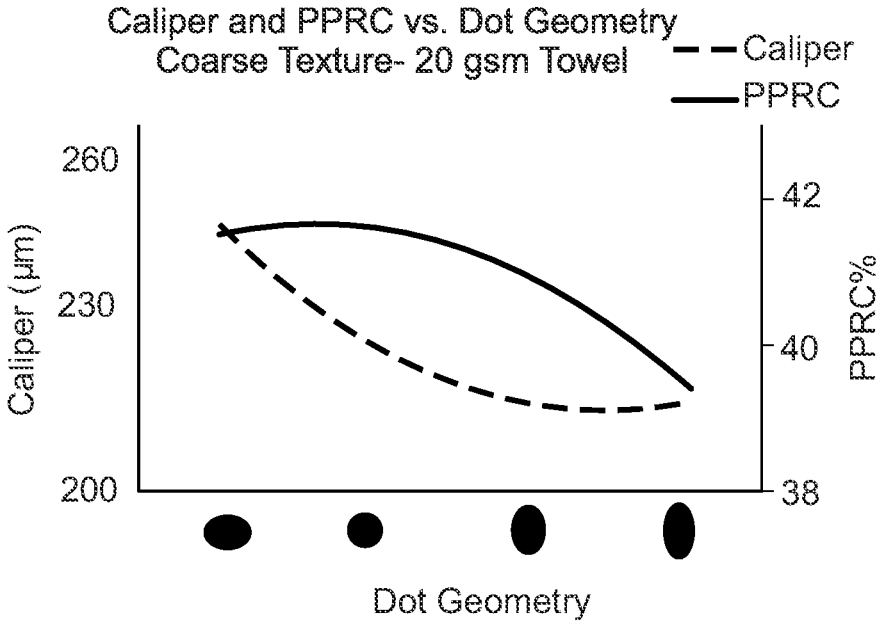
FIG. 15 is a diagram/graph relating to a coarse textured belt and shows the effect of dot geometry for a 20 gsm (g/m$^2$) Towel product when a coarse textured belt is used.

The Coarse texture dot geometry trials showed similar results as seen before, a gain in caliper with an oval that is stretched in the cross-machine direction (to the left in FIG. 14) and a lower caliper with an oval stretched in the machine direction. Slightly improved PPRC is seen with the oval stretched in the cross-machine direction. FIG. 14 shows the graph for Bath grades while FIG. 15 is for Towel grades.

Influence of Dot Diameter on Caliper and PPRC for Coarse Textured Belts

Figure 16:
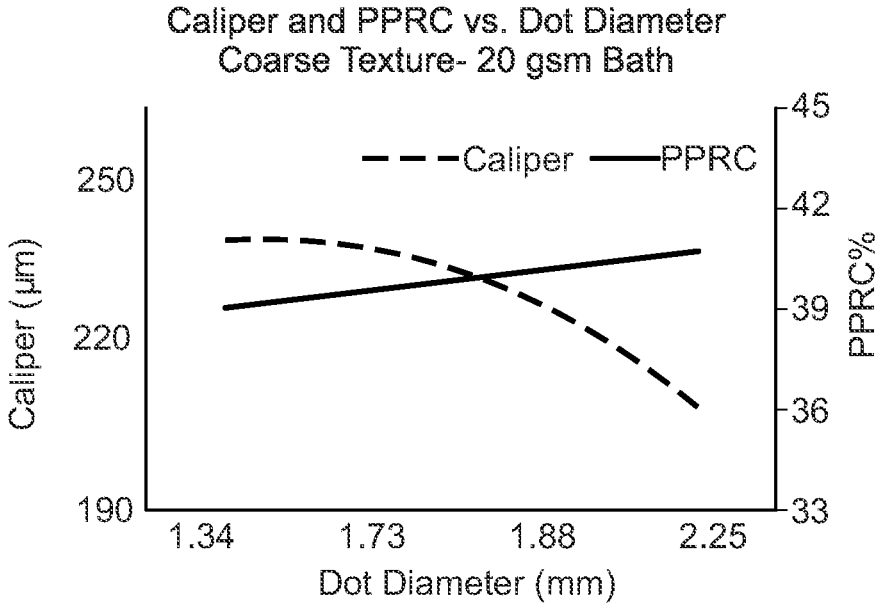
FIGS. 16-20 relate to coarse textured belts and show the effects of different land areas, dot diameter and dot geometry on properties such as caliper, PPRC and smoothness.
Figure 17:
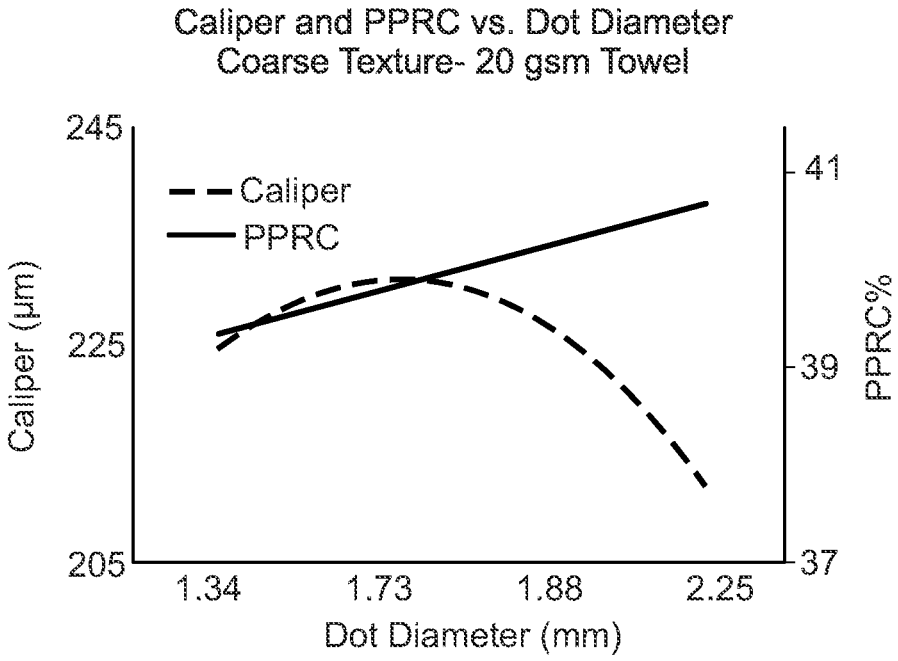

The last variable tested for Coarse textured belts was dot diameter. These trials resulted in interesting findings for caliper and PPRC. The caliper was seen to increase as dot diameter increases until the dot diameter reached 1.73 mm at which point the caliper reached a peak. For larger dot diameters, the caliper decreased. The PPRC curve is again linear, PPRC increases with dot diameter. This is seen as an indication that the larger diameter dot allows for less water to be carried in the bottom of the dot (the dot depth to diameter ratio is decreased). In FIG. 16 and FIG. 17, the PPRC curves for dot depth for Bath and Towel respectively are shown.

Influence of Belt Properties on Surface Smoothness for Coarse Textured Belts

Figure 18:
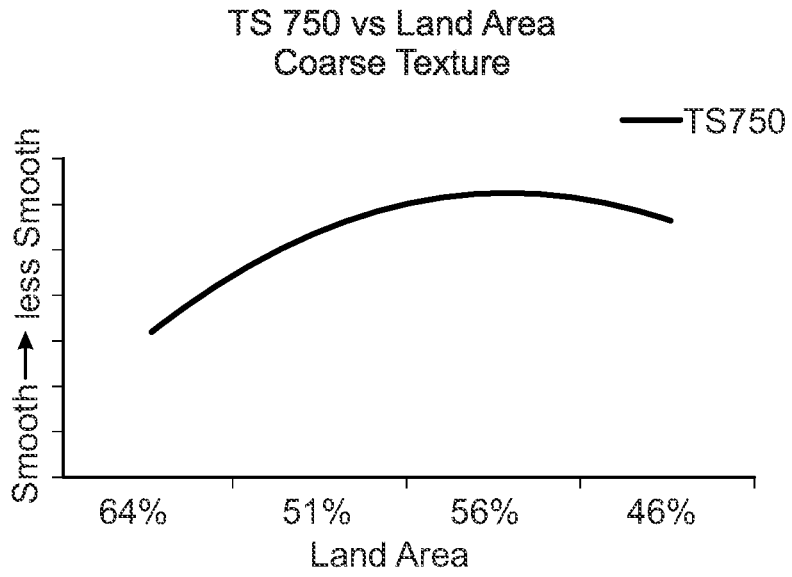
Figure 19:
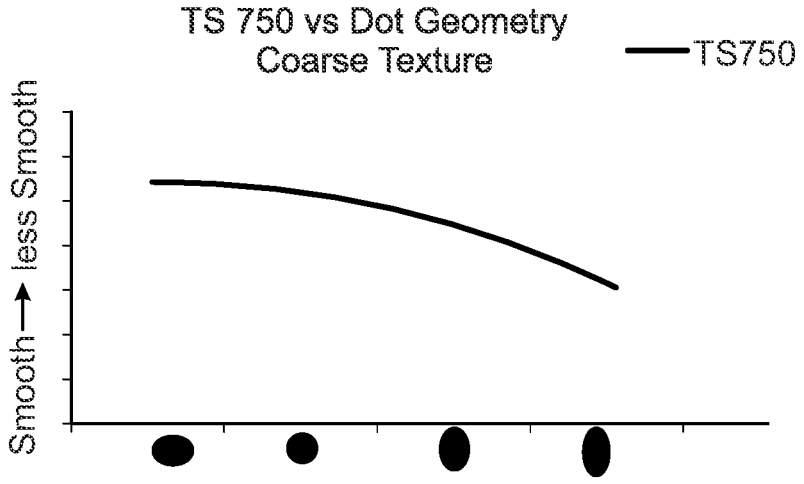
Figure 20:
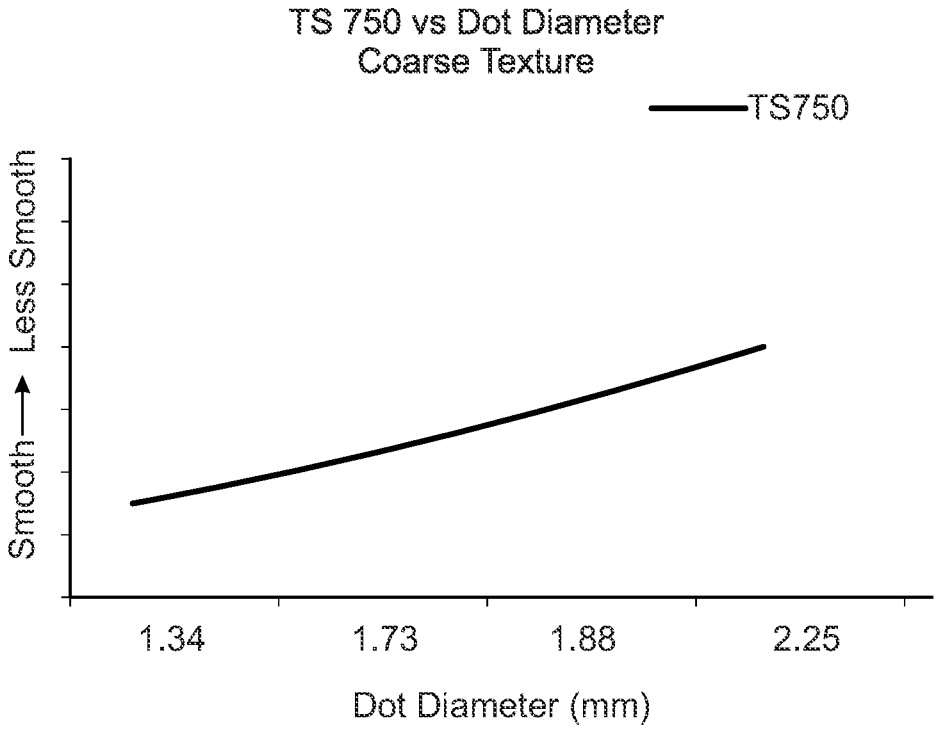

The influence of belt design on smoothness for Coarse textured belts closely follows the results seen on Fine and Medium texture belts. As can be seen in FIG. 18, the higher value for land area results in a smoother sheet while the lower value for land area results in a sheet with more caliper but less smoothness. When looking at dot geometry, the dot that produced the smoothest sheet is again the oval that is stretched in the machine direction as can be seen in FIG. 19 (the dot to the left in FIG. 19). Dot diameter also had some effect and the smaller dot (1.34 mm in diameter) produced the smoothest sheet. It is believed that the larger dots allowed the pocket to collapse to some extent during creping. Whatever the reason, it was seen that the larger dots resulted in a less smooth sheet.

Figure 21:
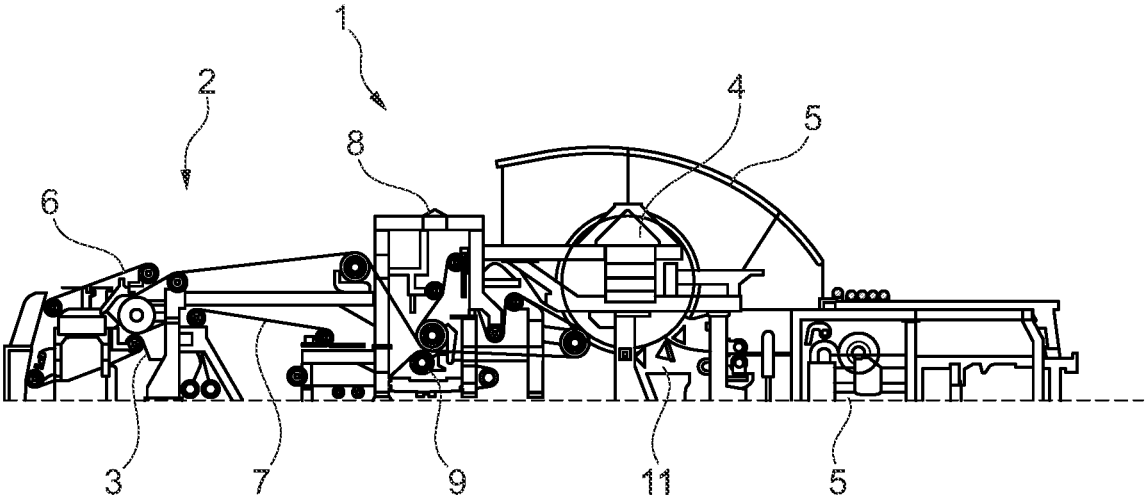
FIG. 21 shows a possible embodiment of a paper making machine which can be used in the present invention.
Figure 22:
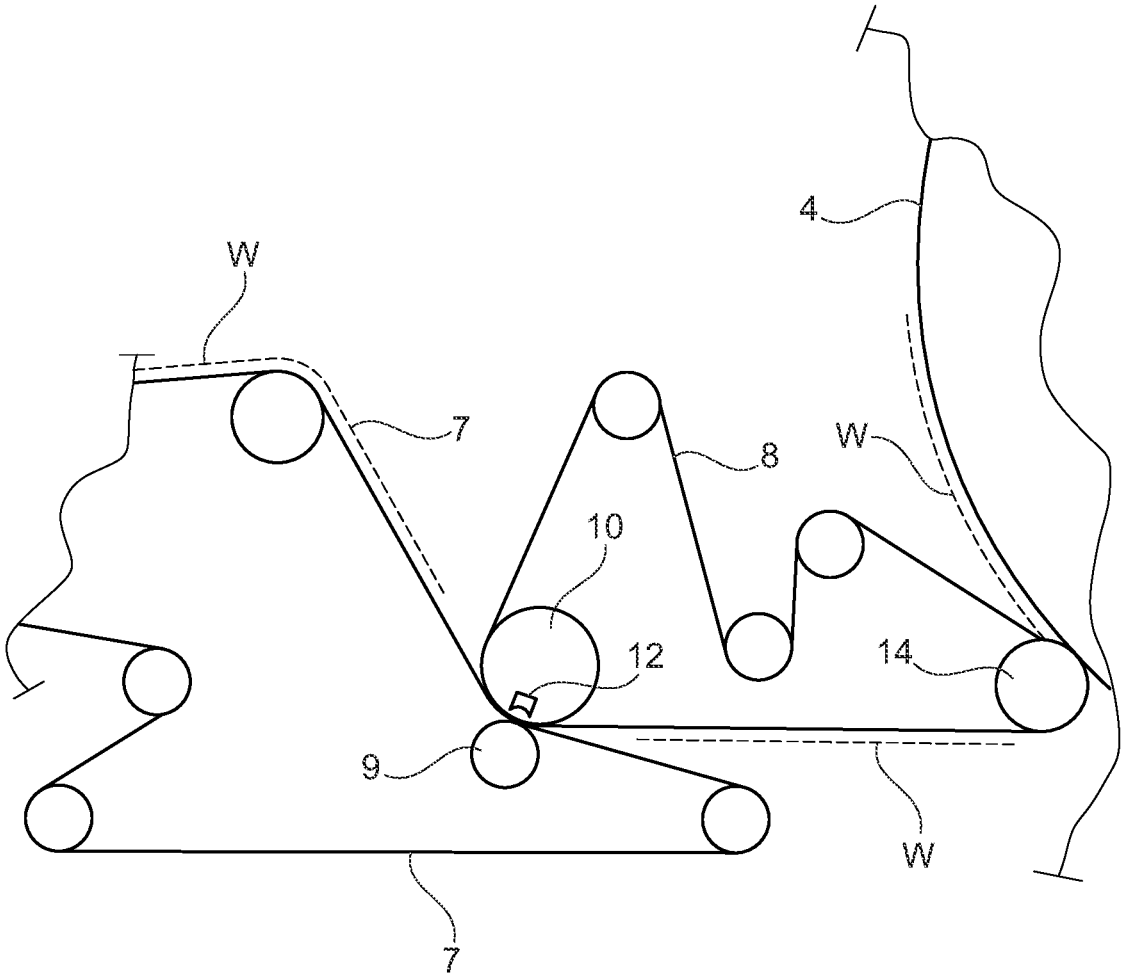
FIG. 22 shows in greater detail a part of the machine of FIG. 21.

With reference to FIG. 21 and FIG. 22, a paper making machine 1 for making tissue paper is shown. The machine of FIG. 21 may be understood as a possible embodiment of the inventive machine and the inventive method may be carried out on such a machine as shown in FIG. 21 but the skilled person will understand that the machine may take other forms.

In the embodiment of FIG. 21 & FIG. 22, the machine comprises a forming section 2 with a head box 3 that is arranged to inject stock between a first forming fabric 6 and a second forming fabric 7. The second forming fabric 7 may be a water-absorbing felt. The newly formed fibrous web W which is initially very wet is passed on a felt (for example the second forming fabric 7) through a press nip formed between a press unit 9 and a press unit 10. The press unit 10 may in particular be a shoe roll with a shoe 12 and a liquid-tight flexible belt that loops the shoe 12 while the press unit 9 may be a press roll. The shoe roll can be placed in an upper position as shown in FIG. 22 but embodiments with a shoe roll in the lower position may also be considered. In the embodiment of FIG. 22, one roll is a lower roll while the other one is an upper roll such that the press plane of the rolls is substantially vertical, but embodiments are conceivable in which the rolls are arranged such that the press plane is not vertical. For example, the rolls can be arranged such that the press plane forms an angle with a vertical plane. The angle with the vertical may be, for example, 5°-45° or even more than 45°. It could even be 90°. A texturing belt 8 is passed through the nip together with the felt 7 and the web W. In the nip, the textured side of the belt 8 faces the web W and water is pressed out of the wet fibrous web W. In the nip between press units 9 and 10, the texturing belt 8 will also impart a texture/three-dimensional structure to the fibrous web W. After the dewatering press nip, the felt 7 is separated from the web W and the web W travels on the lower side of the belt 8 to a transfer nip against the drying cylinder 4. The transfer nip is formed between a transfer nip roll 14 and the drying cylinder 4. In the transfer nip, the wet fibrous web is transferred to the smooth surface of the drying cylinder and travels on the outer surface of the drying cylinder which may be a Yankee cylinder. The web is dried by heat on the drying cylinder. The smooth surface of the drying cylinder helps web transfer to the drying cylinder. The dried web is creped from the drying cylinder by a doctor 11 and brought to a reel-up 5 which may be of any suitable design.

Thanks to the invention as disclosed with reference to FIGS. 1-22, it is possible to select belt properties such that a desired property such as Post Press Roll Consistency or PPRC reaches a desired target value. As used in this patent application, PPRC refers to dryness of the fibrous web after the web has been pressed but before drying on the drying cylinder.

The texturing belt used in the present invention as disclosed with reference to FIGS. 1-22 may in particular be a belt that is impermeable to air or water or has a low permeability to air and water.

It is also to be understood that the category of belt (Fine, Medium or Coarse), the dot geometry, the land area and the dot area or diameter for a belt to be used in the inventive machine may be selected based on the results that can be seen in FIG. 1-FIG. 20, depending on what tissue paper properties that are desired and on what kind of dryness (PPRC) that a manufacturer of tissue wishes to achieve.

Although the invention as disclosed with reference to FIGS. 1-22 has been described in terms of a texturing belt and a machine, it should be understood that those categories only reflect different aspects of one and the same invention. The invention may thus be described as a method comprising such steps that would be the inevitable result of using the inventive machine, regardless of whether such steps have been explicitly mentioned or not. In the same way, the machine may comprise means for performing any method step of the inventive method, regardless of whether such means have been explicitly mentioned or not.

The invention as described with reference to FIGS. 1-22 may also be defined in terms of a method in which a first belt is used to manufacture a first tissue paper product (grade) which first belt has a certain pattern (dot depth, land area, dot shape and dot area) and subsequently replacing the first belt with a second belt having a pattern that differs from that of the first fabric/belt and use the second belt to manufacture a second grade for which the second belt is suitable. The first grade may be, for example, a bathroom grade and the second grade may be towel.

The invention may also be defined in terms of a texturing belt as disclosed with reference to FIGS. 1-20 of this patent application and the applicant reserves the right to file claims directed to such a structuring belt as such.

Thanks to the invention as described with reference to FIGS. 1-20 and FIGS. 21 and 22, it is also possible to select belt properties such that desired target properties such as caliper, smoothness and Post Press Roll Consistency are reached.

A selection can be made among the various embodiments of texturing belts described with reference to FIGS. 1-20 in order to achieve desired properties of the tissue paper and/or to achieve a desired Post Press Roll Consistency and such texturing belts can be used in a machine as shown in FIG. 21 and FIG. 22. The Fine Texture Belts, Medium Textured Belts and Coarse Textured Belts described with reference to FIGS. 1-20 can be used to manufacture tissue paper with good properties but texturing belts with other patterns can also be considered by manufacturers of tissue paper. Some possible embodiments of belt patterns for texturing belts will now be described with reference to FIGS. 23-28. Each of the texturing belts shown in FIGS. 23-28 can be used in a machine as shown in FIG. 21 and FIG. 22 but the texturing belts according to FIGS. 23-28 have properties differing from the texturing belts described with reference to FIGS. 1-20.

Figure 23:
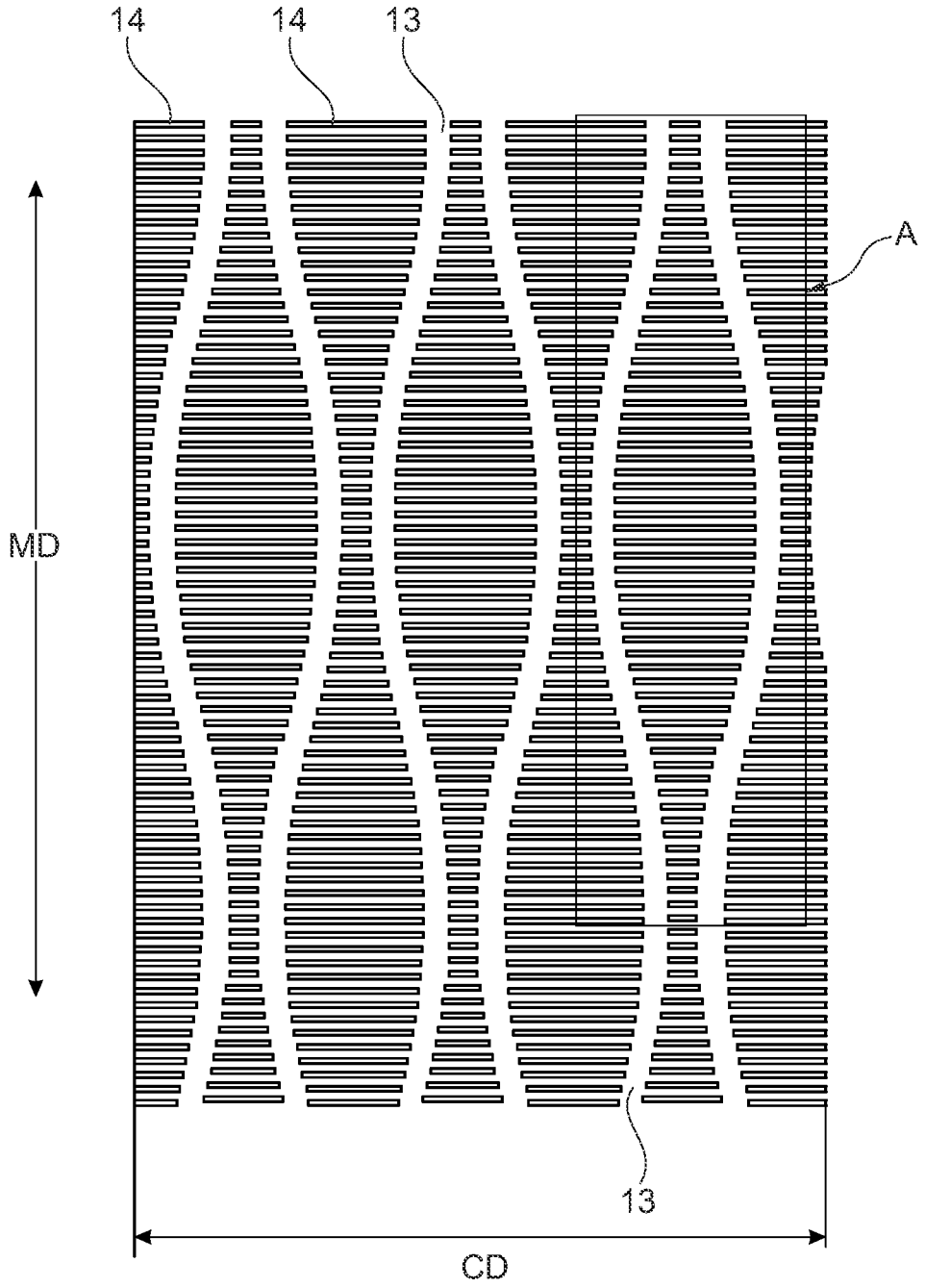
FIGS. 23-28 show patterns for a texturing belt that differs substantially from the belts described with reference to FIGS. 1-20.

Reference will now be made to FIG. 23 which shows that surface of a texturing belt that will be facing the fibrous web when the texturing belt is used in a machine as shown in FIG. 21. The belt pattern shown in FIG. 23 does not have cavities/dots of the kind as disclosed with reference to FIGS. 1-20. Instead, the belt pattern of FIG. 23 is formed by grooves 14 that extend in the cross-machine direction CD. In FIG. 23, the machine direction MD is the direction in which the fibrous web (and the texturing belt) moves when the texturing belt is used to manufacture tissue paper and the cross-machine direction CD is the direction perpendicular to the machine direction MD. FIG. 23 represents a texturing belt that comprises a layer of a polymer material, preferably polyurethane and the grooves 14 have been formed in the layer of polymer material by, for example, laser or some other operation. The grooves 14 are separated by a land area 13 and parts of the land area 13 form sine-shaped wave forms as shown in FIG. 23.

Figure 24:
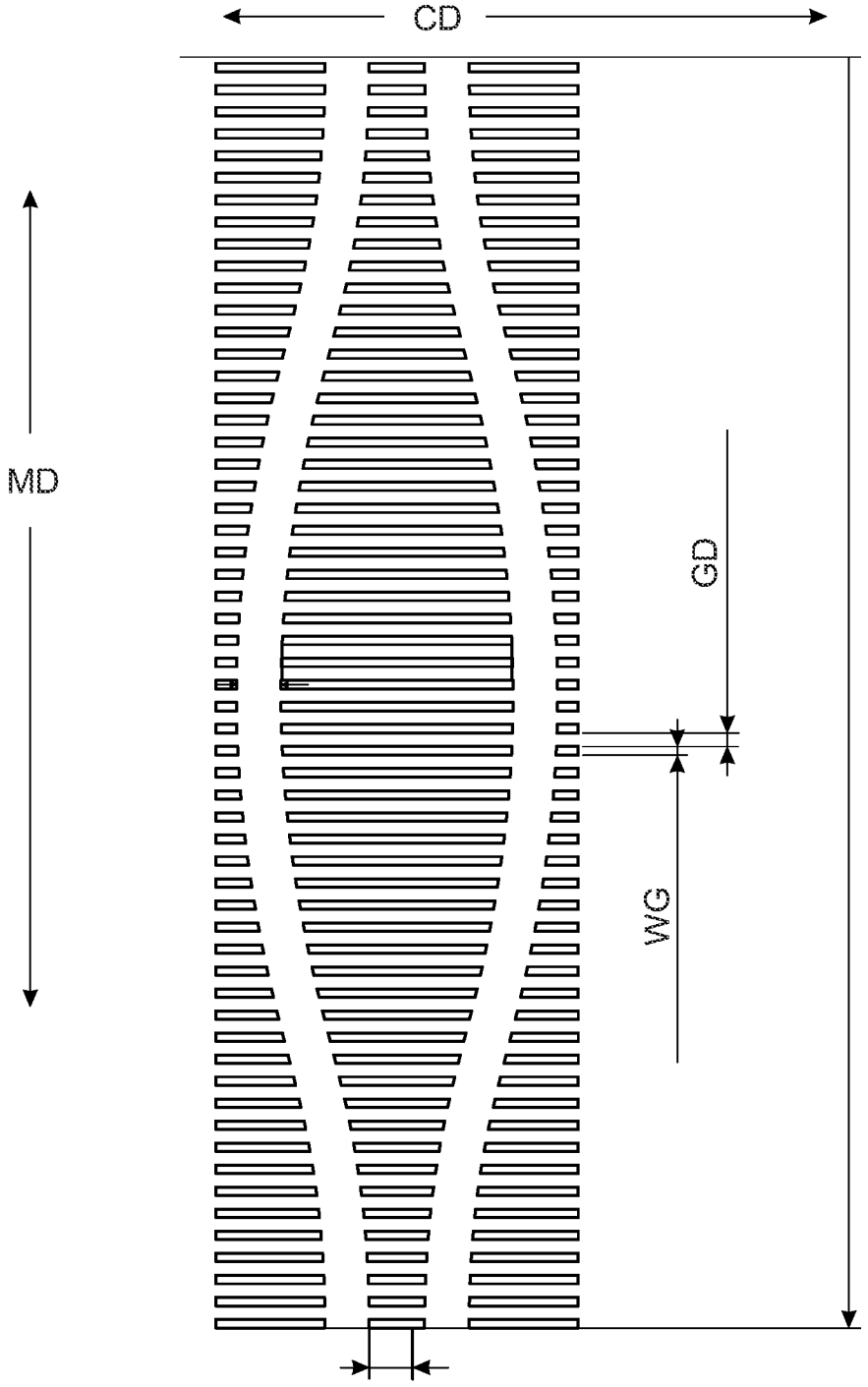

Reference will now be made to FIG. 24 which shows in greater detail the area marked "A" in FIG. 23. In the machine direction MD, the grooved 14 may be separated from each other by a distance GD which may suitably be in the range of 0.6 mm-2.0 m, preferably 0.8 mm-1.5 mm and even more preferred 1.0 mm-1.3 mm. The groove width WG in the machine direction may suitably be in the range of 0.4 mm-2 mm, preferably in the range of 0.8 mm-1 mm and even more preferred in the range of. The depth of the grooves 14 may suitably be in the range of 0.15 mm-0.70 mm, preferably in the range of 0.2 mm-0.4 mm. The land area 13 may suitably constitute 30%-80% of the total surface of that surface of the texturing belt that comes into contact with the fibrous web, preferably 50%-80%. In one embodiment contemplated by the inventors, the groove width WG may be 0.8 mm while the spacing between the grooves 14 in the machine direction (i.e. the distance GD) may be 1.2 mm. In the same embodiment, the maximum width of a groove 14 in the cross-machine direction CD is 20 mm while the minimum width of a groove 14 in the cross-machine direction CD is 4 mm. In that same embodiment, the width of the sine wave (i.e. the distance in the CD direction between two adjacent groves 14) is also 4 mm. The groove depth in that embodiment can be anything from 0.2 mm-0.4 mm. For example, it may be 0.3 mm. It should be understood that the pattern shown in FIG. 23 may represent only a fraction of the entire cross-machine width of the texturing belt and the entire cross-machine direction width of the belt may be in the range of 2 m-8 m or even more than 8 m. In many realistic embodiments, the cross-machine width of the belt may be in the range of 3.5 m-6.5 m. For example, it may be 4 m, 5 m or 5.5 m. The grooves 14 that are stretched/elongated in the cross-machine direction and separated from each other by the land area 13 can create a tissue product with high bulk when the pattern of the belt imprints a three-dimensional pattern in the fibrous web. The part of the land area 13 that form sine-shaped wave forms that extend in the machine direction entails the advantage that, in connection with subsequent creping and/or reeling, the risk that the paper web will become drawn out in the machine direction is reduced.

Figure 25:
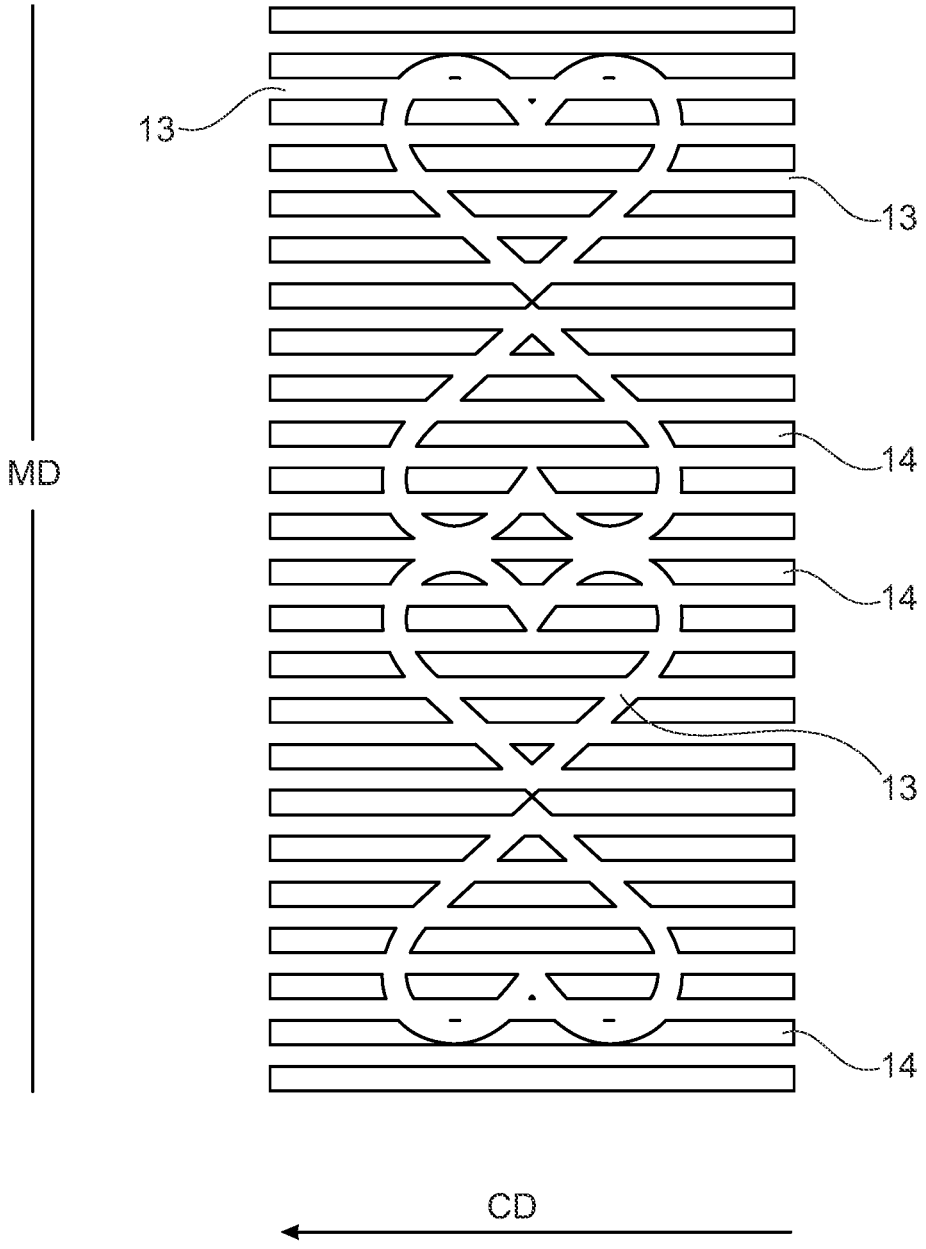

With reference to FIG. 25, another embodiment will now be explained. FIG. 25 represents a pattern for a structuring belt and shows the pattern that will meet the fibrous web. Just as in the embodiment of FIGS. 23 and 24, the pattern has grooves 14 that extend in the cross-machine direction CD. The grooves in the pattern of FIG. 25 are similar to the grooves 14 in the pattern of FIG. 23 and have depth and width in the machine direction with the same dimensions as given for the embodiment of FIGS. 23 & 24. Unlike the pattern of FIGS. 23 and 24, the land area 13 does not form sine-shaped waves but instead heart-shaped patterns. Just as in the embodiment of FIGS. 23 and 24, the land area 13 comprises parts that extend in the machine direction MD. The pattern of FIG. 25 entails the same advantages as the pattern of FIGS. 23 and 24. Just like the structuring belt of FIGS. 23 and 24, the structuring belt of FIG. 25 has a layer of a polymer material such as polyurethane and the pattern of FIG. 25 is formed in that layer of polymer material.

Figure 26:
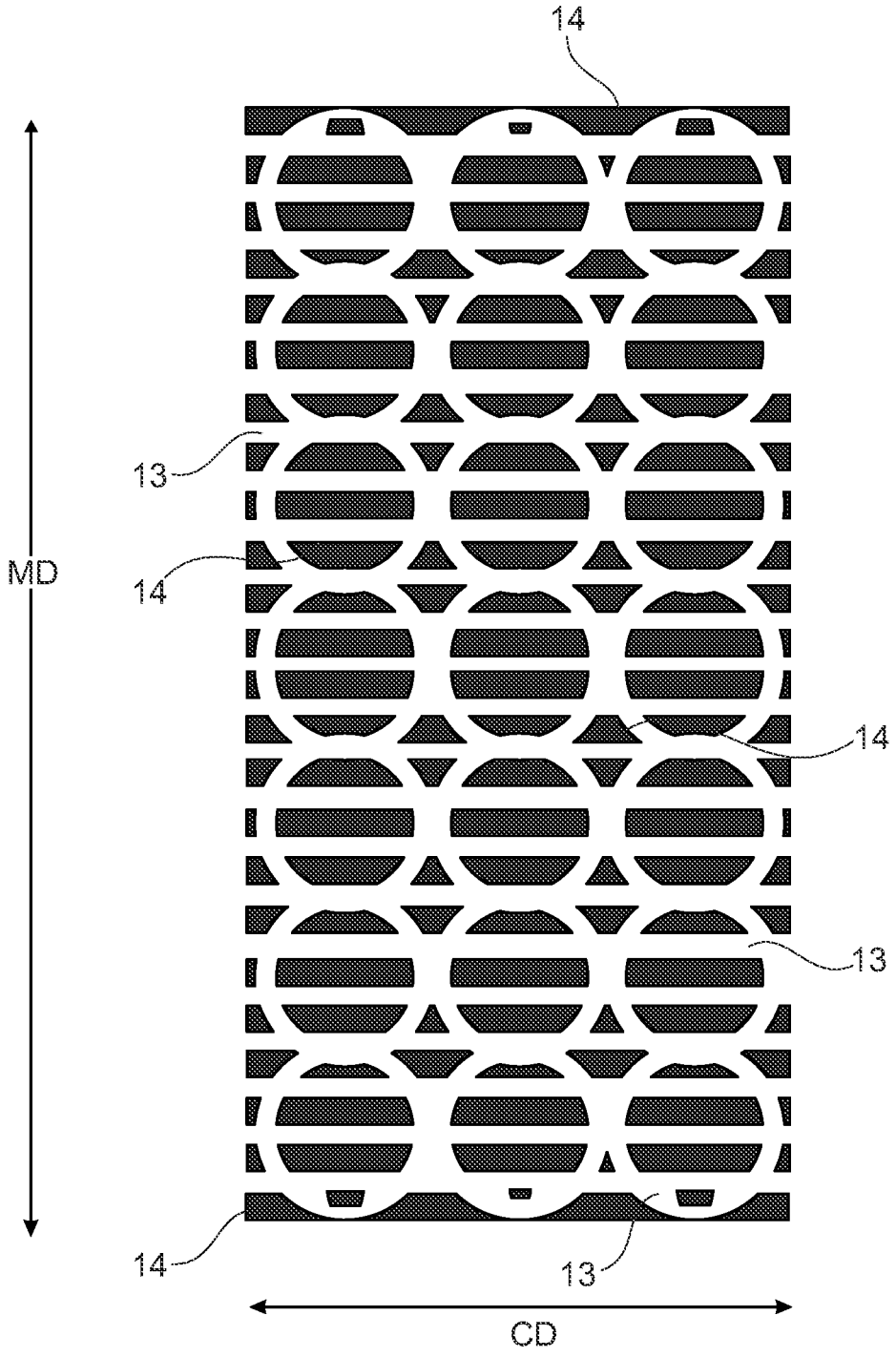

Another embodiment similar to the embodiments of FIGS. 23 and 24 will now be explained with reference to FIG. 26. Instead of a pattern with heart-shaped land areas as in the embodiment of FIG. 25, the land area 14 forms rings. In FIG. 26, the grooves 14 are shown in black while the land area is shown as white. The grooves 14 can have depth and machine direction width as explained with reference to FIGS. 23 and 24. Just as in the embodiments of FIGS. 23-25, the land area 13 extends in the machine direction and gives the same advantage as the embodiments of FIGS. 23-25. The structuring belt the pattern of which is shown in FIG. 26 has a layer of a polymer material such as polyurethane in which layer the grooves 14 are formed and the side of the structuring belt that has the pattern with the grooves 14 will be facing the fibrous web when the belt is used in a machine for making tissue paper. The structuring belt of FIG. 26 may also be used in a machine according to FIG. 21.

Figure 27:
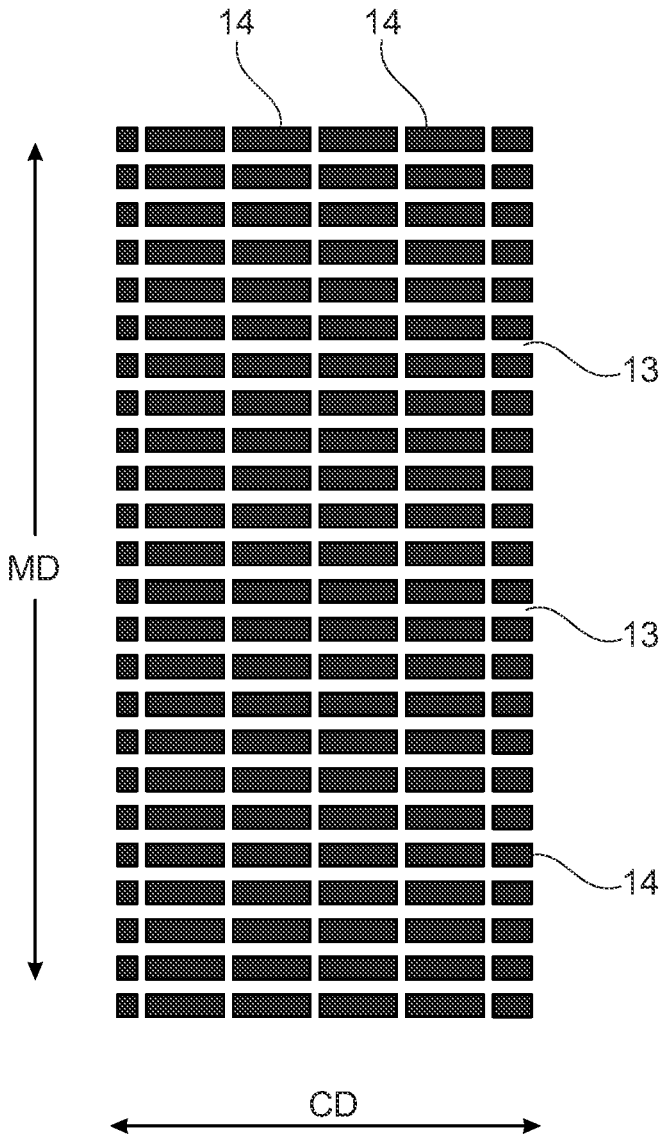

Yet another belt pattern will now be explained with reference to FIG. 27. In FIG. 27, the grooves 14 are indicated in black/dark while the land area 13 separating the grooves 14 from each other is white. The belt of FIG. 27 has a pattern in which grooves 14 extend in the cross-machine direction CD with a width that substantially exceeds their width in the machine direction MD. The grooves 14 are separated from each other in the machine direction MD and in the cross-machine direction CD by land areas 13. The depth of the grooves 14 is in the same range as indicated with reference to the pattern of FIG. 23 and the same is also applicable for the width of the grooves 14 in the machine direction MD. In the cross-machine direction, each groove 14 may have a length in the range of, for example, 4 mm-16 mm. For example, the grooves may have a length of 6 mm, 10 mm or 12 mm. However, groove lengths exceeding 16 mm in the cross-machine direction may also be considered, possibly even up to 30 mm. Parts of the land area 13 form straight lines extending in the machine direction. This feature gives the advantage that the risk that the paper web will become drawn out in the machine direction in connection with for example reeling is reduced. The pattern of FIG. 27 can be used on a belt that has a layer of a polymer material in which the pattern is formed. The polymer material may be polyurethane.

Figure 28:
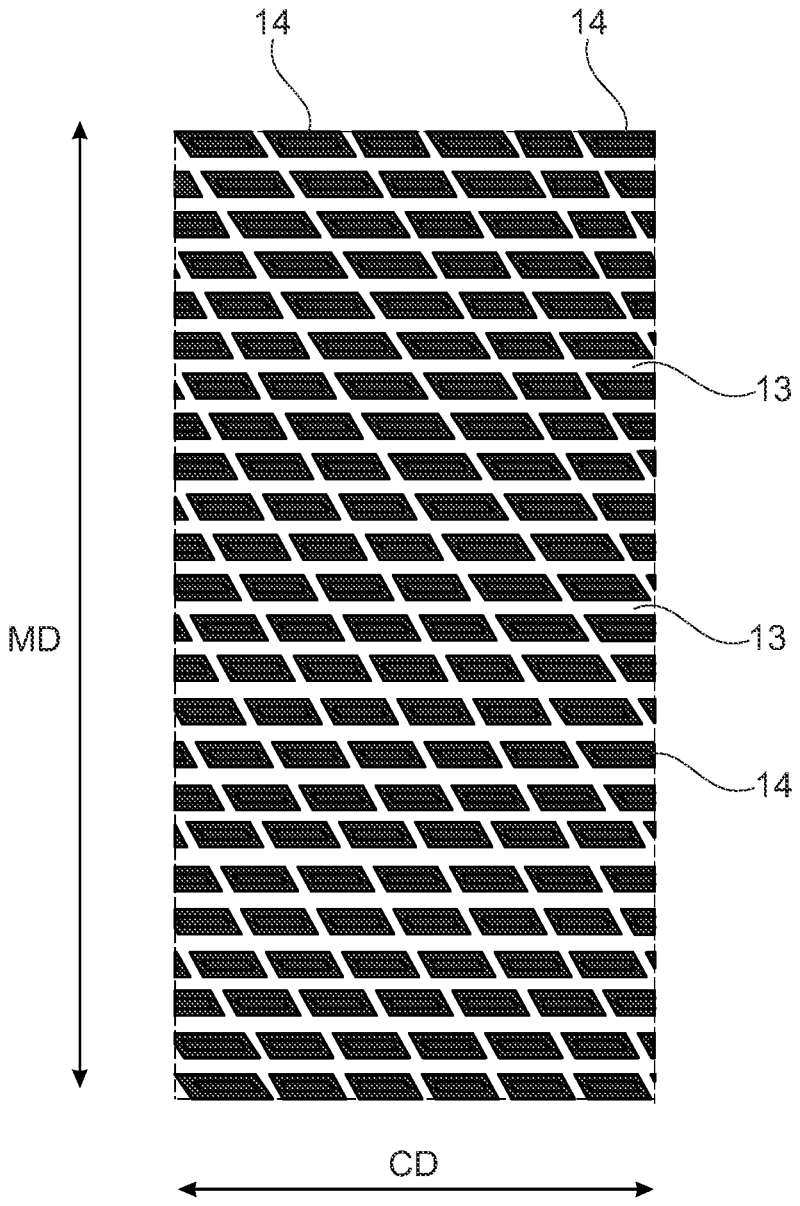

FIG. 28 shows a pattern that is similar to that of FIG. 27 except that the land areas form lines that are slanted in relation to the machine direction MD, i.e. they are at an angle to the machine direction MD. The angle may be in the range of, for example, 10°-60°. For example, it may be 45°, 30° or 20°. The belt with the pattern of FIG. 28 may have a layer of a polymer material in which the pattern is formed such that the surface of the belt will have this pattern. The polymer material may be polyurethane.

Belts using a pattern according to any of FIGS. 23-28 may preferably be impermeable to air and water or at least have a low permeability to air and water.

All belts discussed with reference to FIGS. 1-28 provide the advantage that a three-dimensional pattern can be imprinted into the fibrous web such that the final tissue paper product will become bulkier, smoother and have better absorbency.

The belts with dots/cavities disclosed with reference to FIGS. 1-20 form together a first group of belts that may be referred to as "dot belts". The dot belts with their dots/cavities distributed over their web-contacting surface make it possible to achieve good properties of the final product. The knowledge of how dot geometry, land area, dot area and dot depth influence Post Press Roll Dryness and the properties of the final product also allows the tissue manufacturer to select the belt that is most suitable for a given end product.

The belts with grooves 14 that extend in the cross-machine direction and that have been described with reference to FIGS. 23-28 form a second group of belts that may be referred to as "grooved belts". The grooved belts have the common feature that long continuous land areas extend in the machine direction. This reduces the risk that the ready-dried paper web is drawn out during subsequent operations such as reeling.

Figure 29:
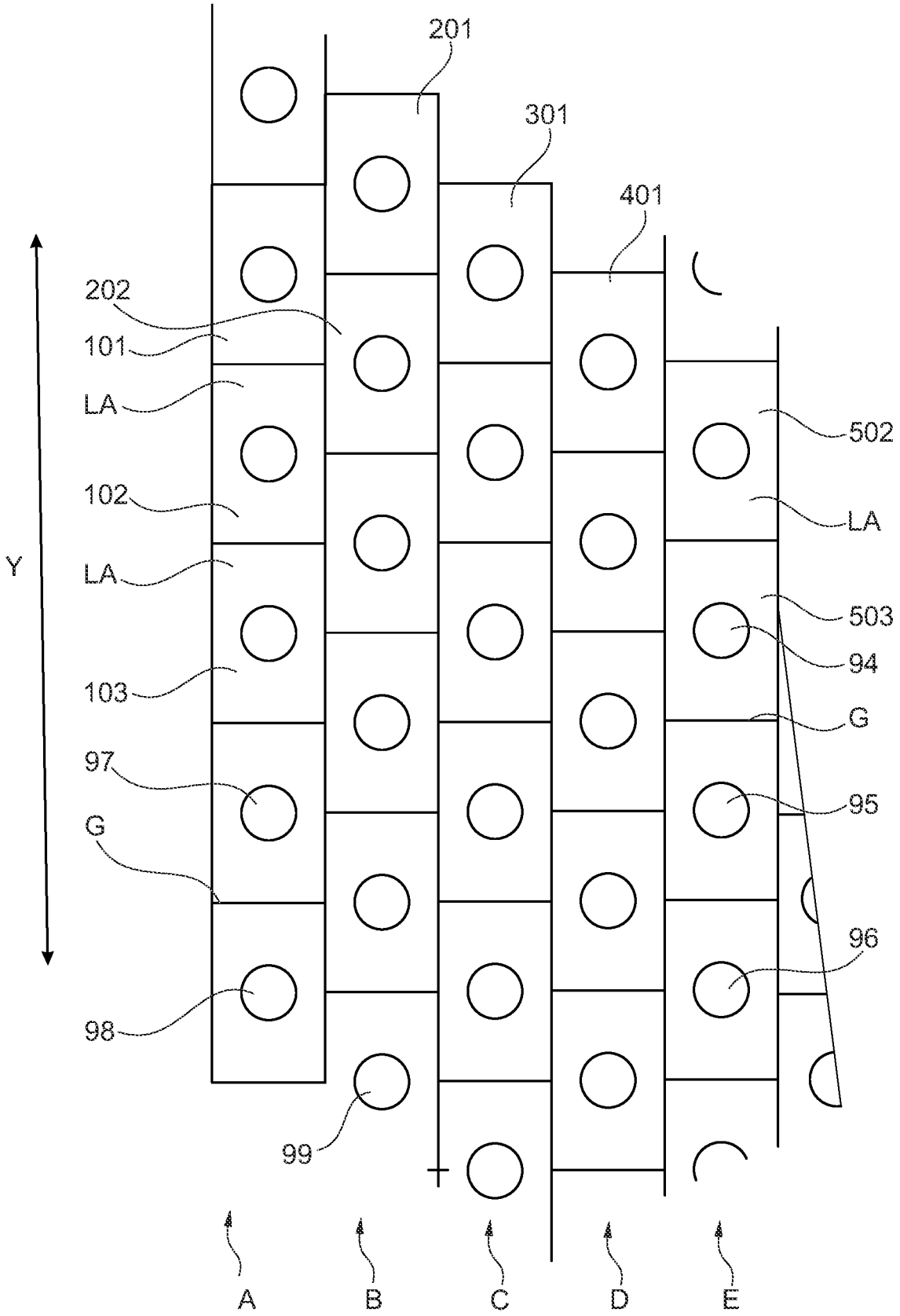
FIG. 29 is a schematic representation of how cavities/dots can form a repeating pattern on the web-contacting surface of a texturing belt.

With reference to FIG. 29, FIGS. 30*a* and 30*b*, FIGS. 31*a* and 31*b* and FIGS. 32*a* and 32*b*, yet another possible embodiment/aspect of the invention will be explained. This embodiment will be explained in the following in terms of how the texturing belt may be designed but it should be understood that the texturing belt described in the following may be used in the inventive method and the inventive machine and everything that is stated about the texturing belt is directly applicable to the inventive method and the inventive machine. The inventive texturing belt for making a three-dimensional pattern in a fibrous web during the manufacture of tissue paper has a side which is intended to contact the fibrous web when the tissue paper is manufactured. With reference to FIG. 29, the web-contacting side has cavities 94, 95, 96, 97, 98, 99 that are distributed in such a way over the web-facing surface that an imaginary grid G which is placed over the web-facing surface divides the surface into a repeating pattern of rectangular cells 101, 102, 103 . . . 201 . . . 301 . . . 401 . . . 502, 503. Each cell comprises at least one cavity 94, 95, 96, 97, 98, 99 and a surrounding land area LA. Each cell extends in the machine direction by 0.5 mm-5 mm, preferably 0.5 mm-4 mm and even more preferred 0.5 mm-3 mm. The depth of each cavity is preferably in the range of 0.10 mm-0.50 mm. For example, the depth may be 0.25 mm, 0.35 mm or 0.40 mm. The land area LA of each cell preferably covers 30%-70% of the total area of the cell. In FIG. 29, the arrow Y may represent either of the machine direction (MD) or the cross-machine direction CD.

As can be seen in FIG. 29, the cells can be distributed in rows A, B, C, D, E. According to one embodiment, the rows A, B, C, D extend in the cross-machine direction and the cells of adjacent rows (for example the cells in the rows A and B) are displaced in relation to each other in the cross-machine direction. In that embodiment, the arrow Y in FIG. 29 represents the cross-machine direction (CD).

According to another embodiment, the cells 101, 102, 103 . . . 201 . . . 301 are distributed in rows A, B, C, D, E that extend in the machine direction and the cells of adjacent rows A, B, C, D are displaced in relation to each other in the machine direction. In that embodiment, the arrow Y in FIG. 29 represents the machine direction (MD).

Figure 30A:
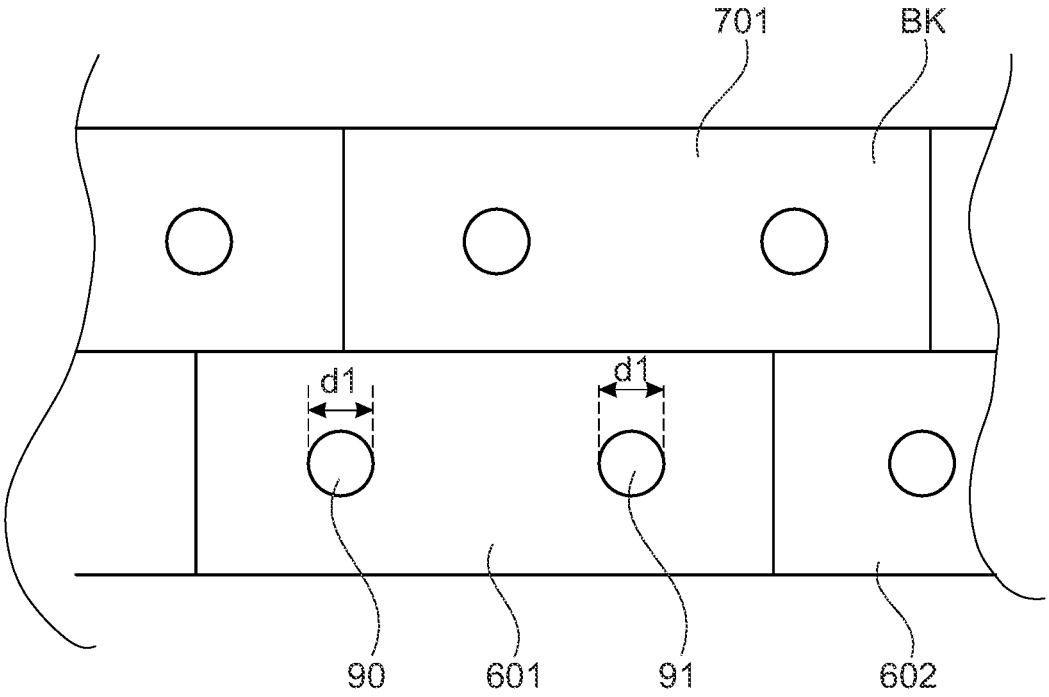
FIGS. 30*a* and 30*b* show, from above and in cross-section, how cavities/dots can form a repeating pattern on the web-contacting surface of a texturing belt.
Figure 30B:
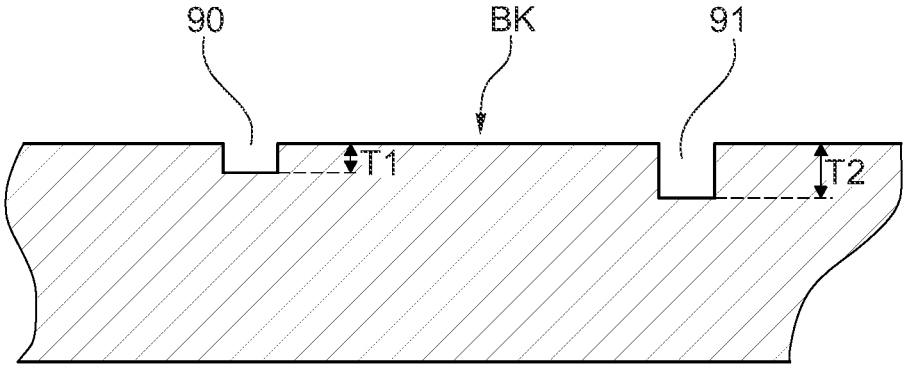

Some special variations of the embodiment with cells in a repeating pattern will now be explained with reference to FIG. 30*a* and FIG. 30*b*. In the embodiment of FIG. 30*a*, each cell 601, 602 comprises two cavities 90, 91 of different depth. Conceivably, each cell could have more than two cavities/dots. FIG. 30*a* shows the pattern of the belt from above such that the web-contacting surface BK is shown. FIG. 30*b* shows a cross-section of the belt. As can be seen in FIGS. 30*a* and 30*b*, the cavities 90, 91 have the same diameter d1 but different depths, T1 and T2 respectively where T2>T1.

Figure 31A:
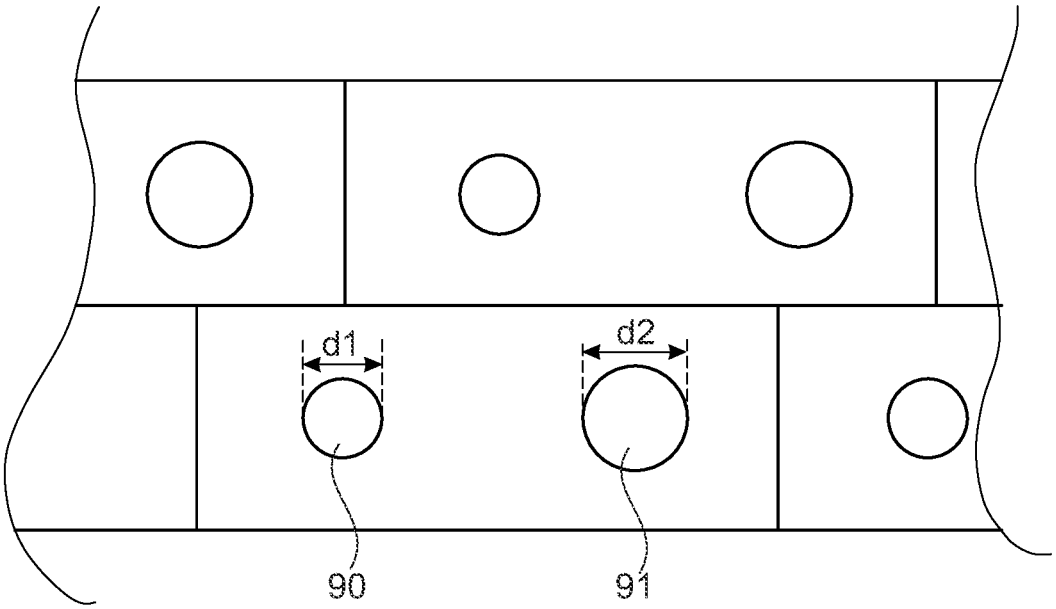
FIGS. 31*a* and 31*b* show, from above and in cross-section, a variation of the pattern shown in FIG. 30*a* and FIG. 30*b*.
Figure 31B:
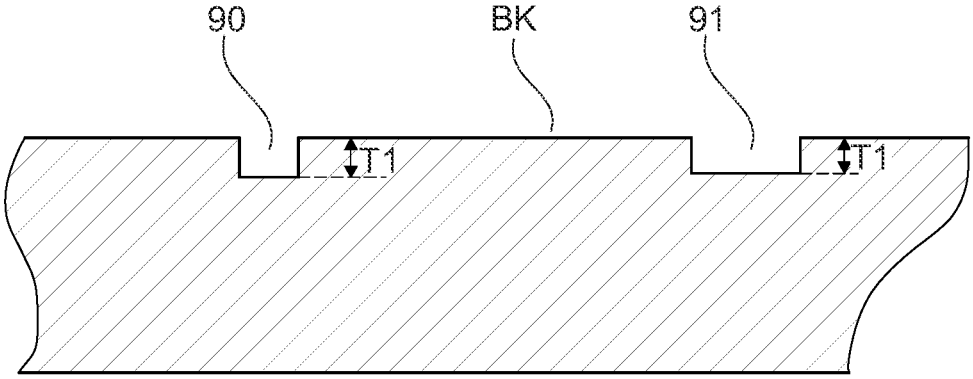

In the embodiment of FIGS. 31*a* and 31 *b*, both cavities 90, 91 have the same depth T1 but they have different diameters d1 and d2 respectively where d2>d1.

Figure 32A:
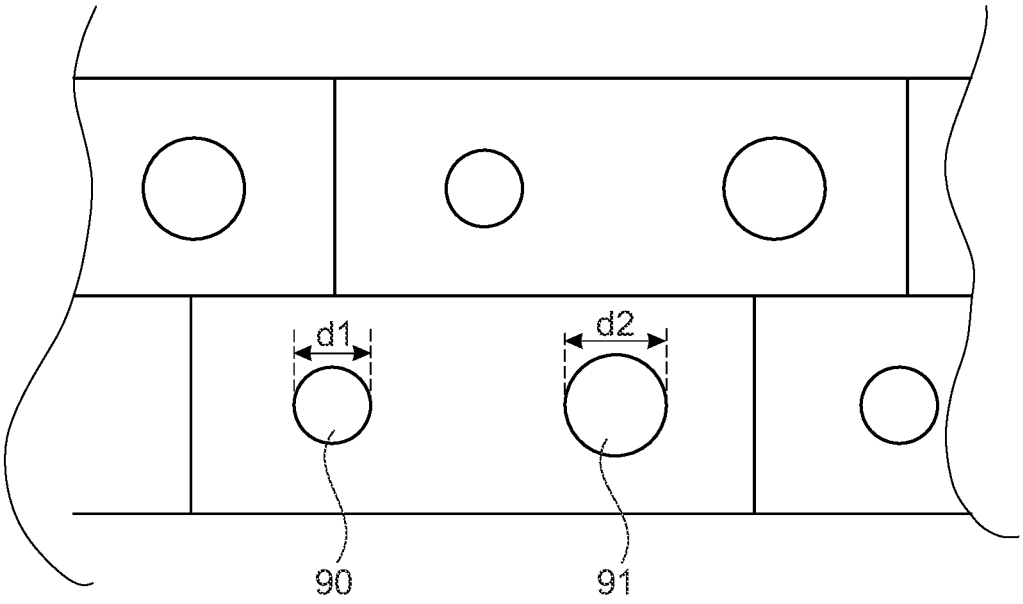
FIGS. 32*a* and 32*b* show, from above and in cross-section, yet another variation of the pattern shown in FIG. 30*a* and FIG. 30*b*.
Figure 32B:
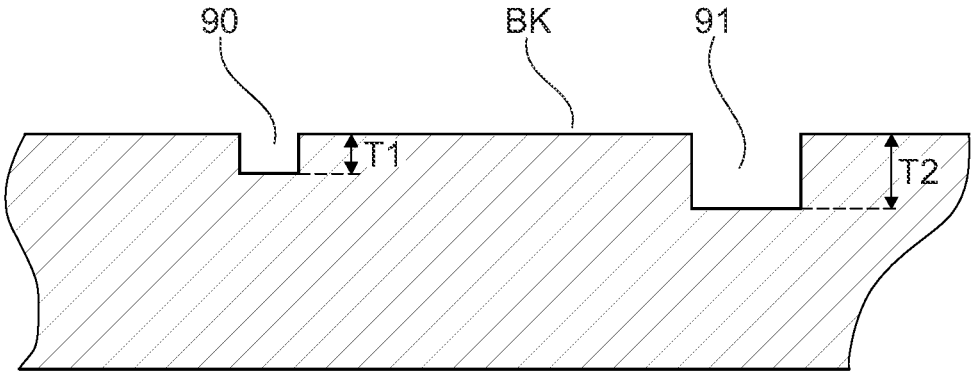

In the embodiment of FIGS. 32*a* and 32*b*, the cavities 90, 91 have both different diameters d1, d2 and different depths T1, T2.

By combining in the same cell (in a repeating pattern of identical cells) cavities/dots of different diameter and/or depth, the manufacturer of tissue paper can fine tune the properties of the belt. This is possible when it is known, for example, that a larger diameter results in more bulk while a smaller depth results in more smoothness.

The invention claimed is:

1. A texturing belt for making a three-dimensional pattern in a fibrous web during the manufacture of tissue paper, the texturing belt having a web-facing surface which is intended to contact the fibrous web when the tissue paper is manufactured, the web-facing surface having cavities that are distributed over the web-facing surface wherein an imaginary grid placed over the web-facing surface divides the surface into a repeating pattern of rectangular cells, wherein the cells are distributed in rows that extend in the cross-machine direction and wherein the cells of adjacent rows are displaced in relation to each other in the cross-machine direction and wherein each cell comprises at least two cavities of different depth and a surrounding land area and wherein each cell extends in the machine direction by 0.5 mm-5 mm.

2. A texturing belt according to claim 1, wherein the texturing belt comprises polymer material.

3. A texturing belt according to claim 1, wherein the cavities have a depth in the range of 0.10 mm-0.9 mm.

4. A texturing belt according to claim 1, wherein a part of the web-facing surface that lies between the cavities defines a surrounding land area which constitutes 30%-70% of the total area of the web-facing surface.

5. A texturing belt according to claim 1, wherein the cavities have a depth in the range of 0.2 mm-0.32 mm, wherein the part of the web-facing surface that lies between the cavities define a surrounding land area which land area constitutes 56-67% of the total area of the web-facing surface, and wherein each cavity has an area of 0.60 $mm^2$-0.70 $mm^2$.

6. A texturing belt according to claim 1, wherein the cells are distributed in rows extending in the machine direction and wherein the cells of adjacent rows are displaced in relation to each other in the machine direction.

7. A texturing belt according to claim 1, wherein each cavity has a circular shape.

8. A texturing belt according to claim 1, wherein each cavity has an oval shape such that the cavity is extended in the machine direction.

9. A texturing belt according to claim 1, wherein each cavity has an oval shape such that the cavity is extended in the cross-machine direction.

10. A texturing belt according to claim 1, wherein a diameter or area of the cavities, the depth of the cavities and the amount of surrounding land area between the cavities of the texturing belt are selected to optimize a desired property of the tissue paper which desired property is one of dryness; the caliper or softness.

11. A machine for making tissue paper, the machine comprising: a forming section; a press having a first press unit and a second press unit between which press units a nip is formed; a drying cylinder which arranged to be heated from the inside by hot steam and on which a fibrous web can be dried by heat; and a texturing belt that is arranged to run in a loop through the nip and to the drying cylinder such that the fibrous web can be carried by the texturing belt to the drying cylinder and transferred to the drying cylinder, wherein a web-facing surface of the texturing belt that contacts the fibrous web comprises a layer of a polymer material such that the polymer material contacts the fibrous web and wherein cavities are formed in that web-facing surface of the texturing belt that comes into contact with the fibrous web, wherein the cavities are distributed over the web-facing surface whereby an imaginary grid placed over the web-facing surface divides the surface into a repeating pattern of rectangular cells, wherein each cell comprises at least two cavities of different depth; and wherein the cells are distributed in rows that extend in the cross-machine direction and wherein the cells of adjacent rows are displaced in relation to each other in the cross-machine direction.

12. A machine according to claim 11, wherein the polymer material is polyurethane.

13. A machine according to claim 11, wherein the cavities have a depth in the range of 0.10 mm-0.9 mm.

14. A machine according to claim 11, wherein a part of the web-facing surface that lies between the cavities define a surrounding land area which constitutes 30% 70% of the total area of the web-facing surface.

15. A machine according to claim 11, wherein the cavities have a depth in the range of 0.2 mm-0.32 mm and wherein the part of the web-facing surface that lies between the cavities define a surrounding land area which constitutes 56%-67% of the total area of the web-facing surface and wherein each cavity has an area of 0.60 $mm^2$-0.70 $mm^2$.

16. A machine according to claim 11, wherein each cell extends in the machine direction by 0.5 mm-5 mm.

17. A machine according to claim 11, wherein the depth of each cavity is in the range of 0.10 mm-0.50 mm.

18. A machine according to claim 11, wherein the surrounding land area of each cell covers 30%-70% of the total area of the cell.

19. A machine according to claim 11, wherein the cells are distributed in rows extending in the machine direction and wherein the cells of adjacent rows are displaced in relation to each other in the machine direction.

20. A machine according to claim 11, wherein each cavity has a circular shape.

21. A machine according to claim 11, wherein each cavity has an oval shape such that the cavity is extended in the machine direction.

22. A machine according to claim 11, wherein each cavity has an oval shape such that the cavity is extended in the cross-machine direction.

23. A machine according to claim 11, wherein the diameter or area of the cavities, the depth of the cavities and the amount of surrounding land area between the cavities of the texturing belt are selected to optimize a desired property of the tissue paper which desired property is one of dryness; the caliper or softness.

* * * * *